US012618572B2

(12) United States Patent
Hughes et al.

(10) Patent No.: US 12,618,572 B2
(45) Date of Patent: May 5, 2026

(54) EDUCTOR WITH INTEGRATED ORIFICE CHECK VALVE AND SCALE CONTROL TRAY

(71) Applicant: RESEARCH PRODUCTS CORPORATION, Madison, WI (US)

(72) Inventors: Nathan Adam Hughes, Madison, WI (US); Steven Farra, Madison, WI (US); Joshua Edwards McKune, Madison, WI (US)

(73) Assignee: Research Products Corporation, Madison, WI (US)

( * ) Notice: Subject to any disclaimer, the term of this patent is extended or adjusted under 35 U.S.C. 154(b) by 492 days.

(21) Appl. No.: 18/093,058

(22) Filed: Jan. 4, 2023

(65) Prior Publication Data

US 2023/0213221 A1 Jul. 6, 2023

Related U.S. Application Data

(60) Provisional application No. 63/296,766, filed on Jan. 5, 2022.

(51) Int. Cl.
*F24F 6/04* (2006.01)
*F24F 6/00* (2006.01)

(52) U.S. Cl.
CPC ..... *F24F 6/04* (2013.01); *F24F 2006/008* (2013.01); *F24F 2221/22* (2013.01)

(58) Field of Classification Search
CPC ..... F24F 6/04; F24F 2006/008; F24F 2221/22
(Continued)

(56) References Cited

U.S. PATENT DOCUMENTS 2,947,452 A 8/1960 Frohmader et al.
2,948,233 A * 8/1960 Emil ..... F25B 1/06 261/36.1

(Continued)

FOREIGN PATENT DOCUMENTS

CN 107328020 11/2017
CN 213237809 5/2021

(Continued)

OTHER PUBLICATIONS

AprilAire HYDRLH Hard Water Maintenance Kit for 720 Series Humidifiers. By Amazon.com. Dated Oct. 14, 2024. Found online [Mar. 25, 2025] https://www.amazon.com/AprilAire-HYDRLH-Maintenance-Humidifiers-ReplacemenUdp/BODK2HQ41V (Year: 2024).

(Continued)

*Primary Examiner* — Charles S Bushey
(74) *Attorney, Agent, or Firm* — Foley & Lardner LLP

(57) ABSTRACT

A humidifying system includes a water panel, and a distribution tray, where the distribution tray provides water to the water panel. The system includes at least one eductor fluidly coupled to the distribution tray and a scale control tray. The system also includes a valve assembly fluidly coupled to a water supply at a first inlet and is fluidly coupled to the at least one eductor via an outlet, where the valve assembly controls water flow through the at least one eductor. The valve assembly includes a second inlet in fluid communication with the scale control tray, where a wastewater flow from the scale control tray through the second inlet is controlled by a first valve and a freshwater flow from the water supply through the first inlet is controlled by a second valve. A configuration of the first valve is based on an operational state of the second valve.

21 Claims, 23 Drawing Sheets

(58) Field of Classification Search
USPC ..... 261/106, 107, 110, DIG. 15, DIG. 46
See application file for complete search history.

(56) References Cited

U.S. PATENT DOCUMENTS

| | | | | | |
|---|---|---|---|---|---|
| 3,058,726 | A * | 10/1962 | Goettl | F24F 6/04 | 261/76 |
| 3,265,371 | A * | 8/1966 | McGrath | F24D 5/00 | 261/36.1 |
| 3,464,400 | A * | 9/1969 | Wellman | F24F 6/04 | 236/44 R |
| 3,464,401 | A * | 9/1969 | McGrath | F24F 6/04 | 236/44 R |
| 5,211,891 | A | 5/1993 | Anoszko | | |
| 5,718,847 | A * | 2/1998 | Koble, Jr. | G05D 9/12 | 137/142 |
| 5,765,544 | A * | 6/1998 | Vigansky, Jr. | F24F 6/00 | 261/106 |
| 5,851,444 | A | 12/1998 | Hansell et al. | | |
| 5,853,625 | A | 12/1998 | Kensok et al. | | |
| 5,919,533 | A | 7/1999 | Smith et al. | | |
| 5,932,148 | A * | 8/1999 | Hansell, Jr. | F24F 6/043 | 261/106 |
| 5,948,324 | A * | 9/1999 | Cook | F23D 14/68 | 261/36.1 |
| 5,971,366 | A | 10/1999 | Smith | | |
| D416,994 | S | 11/1999 | Kensok et al. | | |
| 6,394,427 | B1 * | 5/2002 | Guetersloh | F24F 11/30 | 261/106 |
| D468,798 | S | 1/2003 | Wilder | | |
| 7,950,631 | B2 | 5/2011 | Vasudevan et al. | | |
| 8,096,534 | B2 | 1/2012 | Vasudevan et al. | | |
| D752,178 | S | 3/2016 | Mjelde | | |
| D967,383 | S | 10/2022 | Campbell et al. | | |
| D1,027,155 | S | 5/2024 | Campbell et al. | | |
| D1,040,987 | S | 9/2024 | Campbell et al. | | |
| 2002/0171158 | A1 | 11/2002 | Bloemer | | |
| 2006/0208369 | A1 * | 9/2006 | Hayden | B05B 17/085 | 261/36.1 |
| 2008/0018001 | A1 | 1/2008 | Kammerzell et al. | | |
| 2009/0102073 | A1 | 4/2009 | Vasudevan et al. | | |
| 2011/0068491 | A1 | 3/2011 | Wang et al. | | |
| 2011/0193246 | A1 | 8/2011 | Vasudevan et al. | | |
| 2023/0213221 | A1 | 7/2023 | Hughes et al. | | |
| 2023/0392803 | A1 | 12/2023 | Schatz et al. | | |
| 2024/0219046 | A1 * | 7/2024 | Hughes | F24F 6/04 | |

FOREIGN PATENT DOCUMENTS

| | | |
|---|---|---|
| WO | WO-00/10695 | 3/2000 |
| WO | WO-2018/227000 | 12/2018 |

OTHER PUBLICATIONS

Honeywell Frame and Tray Assembly for HE200 HE 250. By Supplyhouse.com. Dated Feb. 24, 2024. Found online [Mar. 25, 2025] https://web.archive.org/web/20240224004839/https://www.supplyhouse.com/Honeywell-Home-50041861-002- Frame-and-Tray-Assembly-for-HE200-H E250 (Year: 2024).

* cited by examiner

EDUCTOR WITH INTEGRATED ORIFICE CHECK VALVE AND SCALE CONTROL TRAY

CROSS-REFERENCE TO RELATED APPLICATIONS

The present application claims priority to U.S. Provisional Patent Application No. 63/296,766, filed Jan. 5, 2022, the entire contents of which are incorporated by reference herein.

BACKGROUND

The present disclosure relates generally to humidifying systems for increasing humidity of ambient air. More specifically, the present disclosure relates to a humidifier having an eductor formed from a scale control tray and valve interface which reduces overall water usage of the humidifier and increases efficiency while also increasing water flow rate to the humidifier media (e.g., a water panel) during humidification in a whole home application.

SUMMARY

One aspect of the present disclosure relates to a humidifying system. The humidifying system includes a water panel and a distribution tray fluidly coupled to the water panel, where the distribution tray is configured to provide a flow of water to the water panel. The system further includes at least one eductor, which may also be referred to as a jet pump or venturi pump, fluidly coupled to the distribution tray and a scale control tray in fluid communication with the water panel, where the scale control tray is configured to receive wastewater from the water panel. The system also includes a valve assembly fluidly coupled to a water supply at a first inlet and fluidly coupled to the at least one eductor via an outlet, where the valve assembly is configured to control a flow of water through the at least one eductor. The valve assembly includes a second inlet, the second inlet being in fluid communication with the scale control tray, where a flow of wastewater from the scale control tray through the second inlet is controlled by a first valve (e.g., a check valve with an orifice) within an interface between the second valve and the scale control tray, and a flow of freshwater from the water supply through the first inlet is controlled by a second valve (e.g., solenoid valve). A configuration of the first valve is based on an operational state of the second valve, which may be a pilot operated check valve. In various embodiments, the specific arrangement of the scale control tray with the at least one eductor and valve assembly, which includes the first valve (e.g., a movable check valve with an orifice), enables the at least one eductor and a drain assembly in fluid communication with the at least one eductor to function in a synergistic manner where both the first valve and the at least one eductor cooperate to facilitating reducing overall water usage of the humidifying system, increasing efficiency, and increasing water flow rate to the water panel. In one embodiment, the eductor is formed by a combination of the scale control tray and the valve assembly. In other embodiments, the eductor may be formed separate from the scale control tray and attached (e.g., via threads) to the valve assembly.

In various embodiments, the first valve is a check valve with an orifice and the second valve is a solenoid valve. In some embodiments, the first valve is a piston type check valve with o-ring. In other embodiments, the first valve can also include a flexible diaphragm or membrane style valve with a fixed seal. In other embodiments, the valve assembly includes a spring disposed between the first valve and the at least one eductor, the spring being configured to bias the first valve in an open configuration (i.e., open to drain waste water from the scale control tray). In yet other embodiments, the spring is a compression spring. In various embodiments, the spring is an extension spring, which is configured to threadably engage with at least one of the first valve or the second valve. In some embodiments, the operational state of the second valve includes a first state and a second state, such that when the second valve is in the first state, the first valve is in the open configuration (i.e., to allow drainage of wastewater), and when the second valve is in the second state, the first valve is in a closed configuration (i.e., where a drain in fluid communication with the first valve is closed and the at least one eductor is enabled). In other embodiments, the first valve includes at least one orifice, such that when the first valve is in the closed configuration, the flow of wastewater from the scale control tray is received by a drain.

In various embodiments, the system further includes a collection member, the collection member being disposed between the first inlet and the scale control tray. In some embodiments, the valve assembly is integrally formed with the scale control tray. In other embodiments, the system includes a frame, where the water panel is pivotably coupled to the frame and the valve assembly is coupled to the frame. In yet other embodiments, the valve assembly is removably coupled to the scale control tray.

Another aspect of the present disclosure relates to a humidifying system. The system includes a frame and a water panel coupled to the frame. The system also includes at least one eductor in fluid communication with the water panel, where the at least one eductor is configured to provide a flow of water to the water panel. The system further includes a scale control tray in fluid communication with the water panel, where the scale control tray is configured to receive wastewater from the water panel. The system also includes a valve assembly fluidly coupled to a water supply at a first inlet and fluidly coupled to the at least one eductor via an outlet, the valve assembly being configured to control a flow of water through the at least one eductor. The valve assembly includes a second inlet, the second inlet being in fluid communication with the scale control tray, where a flow of wastewater from the scale control tray through the second inlet is controlled by a first valve within the valve assembly and a flow of freshwater from the water supply through the first inlet is controlled by a second valve. A configuration of the first valve is based on an operational state of the second valve.

In various embodiments, the valve assembly is removably coupled to the scale control tray. In some embodiments, the at least one eductor includes a first eductor and a second eductor. In other embodiments, the base includes a first end and a second end, where the at least one eductor is disposed at the first end and the second eductor is disposed at the second end, and where the valve assembly is couplable to the first end or the second end. In yet other embodiments, the system also includes a collection member, the collection member being disposed between the first inlet and the scale control tray. In various embodiments, the collection member includes a body, the body having a shape that is complementary to a shape of the valve assembly, where the body is configured to enclose at least a portion of the valve assembly. In some embodiments, the body includes a drain spud. In other embodiments, the first inlet is in fluid communication with the drain spud. In other embodiments, the first valve (which may include at least one orifice) and the at least one eductor form a separate assembly that is connected to the second valve via a pressurized fluid. In some embodiments, a top portion (e.g., an upper half) of the at least one eductor and a drain passage can be molded into the scale control tray as an integrally formed piece. In other embodiments, the top portion of the at least one eductor and the drain passage are formed as separate pieces, which are configured to couple to the scale control tray. In other embodiments, the first valve (e.g., pilot operated check valve), which is configured to control drain, can be disposed separate from the orifice and located non-concentrically to a primary flow path through the humidifying system (e.g., through the valve assembly) and connected to the primary flow path by one or more separate fluid lines or connections.

This summary is illustrative only and should not be regarded as limiting.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Figure 1:
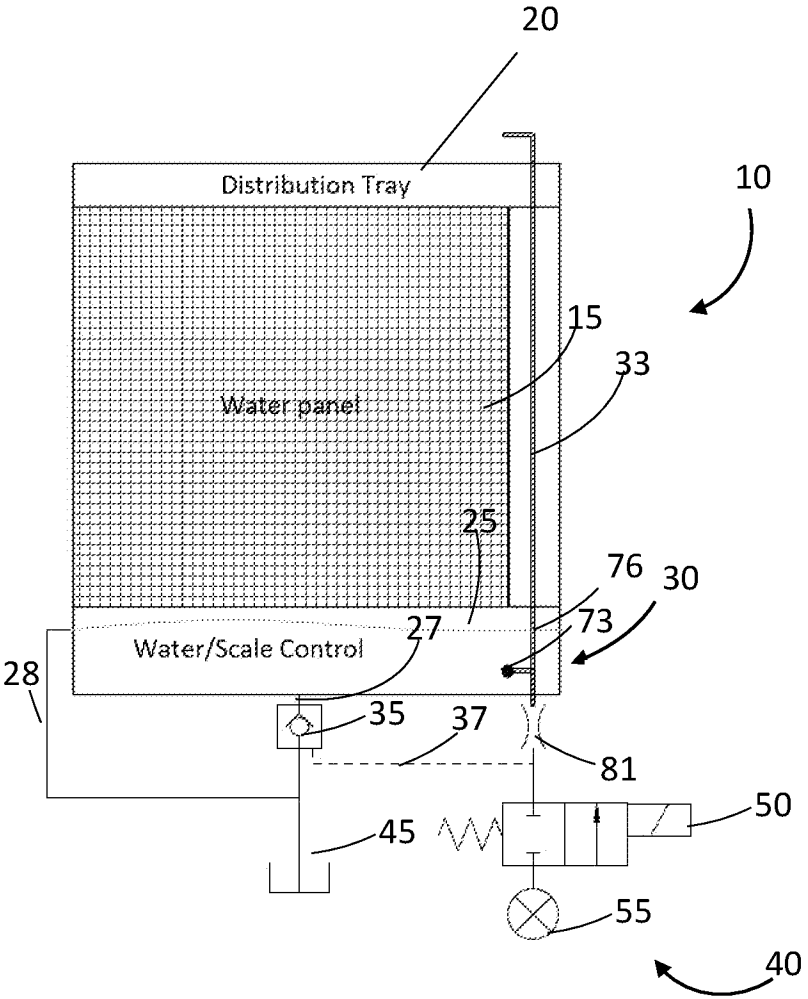
FIG. 1 is a schematic view of a scale control tray and valve interface of a humidifier, according to an exemplary embodiment.

Referring to FIG. 1, a schematic representation of a humidifier system 10 is shown, according to an exemplary embodiment. The system 10 includes a water panel 15, which is coupled to or housed within a distribution tray 20 and a water or scale control tray 25. The scale control tray 25 may be integrally formed with an eductor 30 (e.g., a jet pump), which is fluidly coupled to a distribution conduit 33 to facilitate flow of water to the distribution tray 20 and thus to the water panel 15. Eductor 30 includes an inlet 73 that receives water from the scale control tray 25. Flow of water through the scale control tray 25 and flow of water into the eductor 30 is further facilitated by a scale control tray and valve interface assembly 40. The assembly 40 includes a check valve 35, a solenoid valve 50, and an orifice.

As shown, the scale control tray 25 is coupled to the check valve 35 via a conduit 27, where the check valve 35 may facilitate drainage of water (i.e., wastewater) away from the scale control tray 25 to a fluidly coupled drain 45 and/or to the eductor 30 via conduit 37. The drain 45 may also be fluidly coupled to an overflow conduit 28, which is fluidly coupled to the scale control tray 25. Due to a potential for varying water pressure from the water source 55 (i.e., resulting from a varying water pressure within a house containing the humidifier system 10), in various embodiments, the humidifier system 10 is configured such that an overall flow rate through the system 10 (e.g., 2 gallons per hour) is higher than a rate of water evaporation (e.g., 0.7-1.0 gallons per hour). Accordingly, the greater flow rate compared to the evaporation rate results in wastewater flowing through the overflow conduit 28 (e.g., at a rate of 1-1.3 gallons per hour) to the drain 45. Because the scale control tray 25 is fluidly coupled with the eductor 30 to distribute at least a portion of the wastewater from the scale control tray 25 back to distribution tray 20, an amount of water flowing through the overflow conduit 28 may be reduced and thereby further reduce water consumption of the system 10.

The eductor 30 includes an inlet conduit 81. Pressurized water from a pressurized water source 55 (i.e., disposed upstream of the inlet conduit 81) is provided to the eductor 30 via the inlet conduit 81. A pilot pressure line 37 is disposed between the eductor 30 (and the inlet conduit 81) and the check valve 35 and is configured to apply pilot pressure to seal a drain when pressure is present at an orifice (such as the inlet conduit 81) of the eductor 30. The pressurized water source 55 may be a water supply coupled to the humidifier system 10. In some embodiments, pressure of water from the water source 55 may be approximately 50 psi nominal. Flow from the water source 55 may be facilitated by a solenoid valve 50. In various embodiments, the check valve 35 may require a differential pressure (i.e., across an inlet and outlet of the check valve 35) to function. In some embodiments, the differential pressure is controlled by the solenoid valve 50, such that when the solenoid valve 50 is on, a pressure caused by operation of the solenoid valve 50 closes the check valve 35 (and thus closes fluid flow to the drain 45). Furthermore, in this embodiment, when the solenoid valve 50 is off, pressure may decrease (e.g., bleed down) and a spring (or other biasing member) within the check valve 35 may bias the check valve 35 open such that wastewater may flow to the drain 45.

Figure 2:
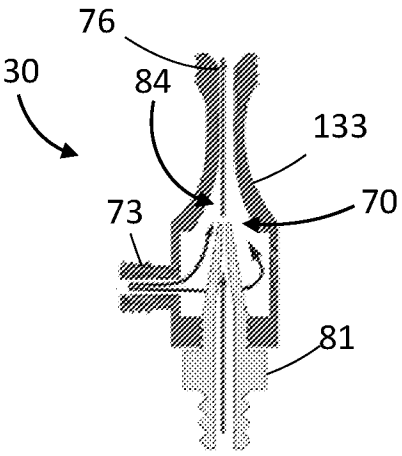
FIG. 2 is a schematic view of an eductor formed from the scale control tray and valve interface of FIG. 1, according to an exemplary embodiment.

FIG. 2 shows a schematic representation of the eductor 30, according to an exemplary embodiment. As shown, the eductor 30 includes a body 70 having an outer wall 133 that defines an interior volume. In certain embodiments (as shown for example in FIGS. 4-8), the outer wall 133 and one or more components of the body 70 are formed as part of or molded together with a scale control tray and the inlet 81 is formed as a part of a separate valve assembly. In other embodiments (as shown for example in FIG. 8*a*), the outer wall 133 and one or more components of the body 70 are formed as part of a separate eductor component that is mated with the scale control tray via an opening within the scale control tray. In still further embodiments, the eductor (including the inlet 73, outer wall 133, body 70, and inlet 81) may be formed completely within the scale control tray such that pressurized water is provided to inlet 81 via a separate water valve that is connected via a seal to the inlet 81 of the eductor.

Water received through the inlet 73 and the inlet 81 is combined within the body 70, such that the combined water then flows through an outlet 76. The inlet 73 is configured to receive water from the scale control tray 25 at eductor 30. The second inlet 81 is configured to receive water from the water source 55 from a supply outlet connected to the valve 50. As shown, the inlet 81 provides pressured water that forms a converging/diverging nozzle 84 within the body 70 by creating a localized low-pressure region, which draws water into the eductor 30 through the inlet 73 and from the scale control tray 25 to combine with the fresh water flowing into the body 70 via the inlet 81. Combined water received through both of the inlets 73 and 81 may then be driven out of the eductor 30 via the outlet 76 to the distribution conduit 33. In various embodiments, accumulation of water within the scale control tray 25 causes an increase in head pressure, which helps to open the check valve 35 (in optional combination with the solenoid valve 50 being turned off and corresponding check valve holding pressure being bled down and/or a spring load applied to open the check valve) to allow flow of water from the scale control tray 25 to the drain 45. Accordingly, this design improves efficiency of the eductor 30 at least because water accumulation within the scale control tray 25 creates head pressure (i.e., within the inlet 73) that facilitates operation of the eductor such that wastewater in the scale control tray 30 is pulled into the eductor 30 and passed back to the distribution tray 20, thereby conserving water within the humidifier system. In some implementations, the resultant water flow rate out of the eductor 30 may be six to ten times greater than a flow rate of water dependent on pressure from the water source 55 alone. Increased water flow rates through the assembly 40 (i.e., facilitated by the combined flows from inlets 73 and 81), and thus increased water flow rates through the distribution conduit 33, enables full wetting of the water panel 15 while simultaneously reducing an amount of overall water consumption by the humidifier assembly 10. These increased flow rates and the conservation of wastewater by the system allows for a more efficient (and lower flow rate)

valve design while still maintaining a higher continuous flow rate to the distribution tray 20 and corresponding water panel.

In various embodiments, a humidifier system may be configured such that any or all of the check valve (e.g., the check valve 35), the solenoid valve (e.g., the solenoid valve 50), and/or the eductor (e.g., the eductor 30) are arranged within the scale control tray and valve interface assembly (e.g., the assembly 40) such that the assembly includes an integrated valve assembly coupled to an eductor interface. Such an arrangement may facilitate reduced complexity, cost, and control (i.e., minimization) of stagnant water that may accumulate within a scale control tray (e.g., similar or equivalent to the scale control tray 25) as compared to a standard humidifier system. The resulting reduction in stagnant water reduces scale accumulation, improves function, and reduces microbial growth as compared to systems without the foregoing arrangement. In still further embodiments, alternative valve configurations may be used. For example, the check valve may be omitted altogether. Furthermore, multiple solenoid valves may be used such that one solenoid valve operations a fresh water supply and a second solenoid valve operates a drain.

Figure 3:
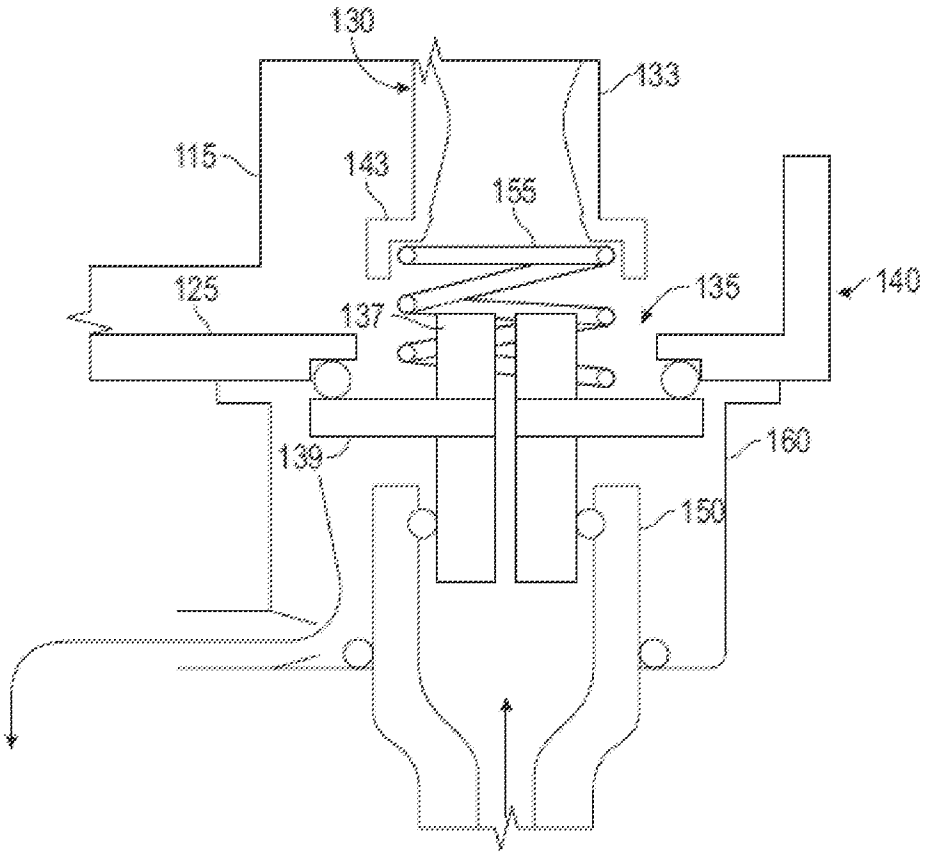
FIG. 3 is a schematic representation of a cross-sectional view of an eductor configured for integration with the valve interface of FIG. 1, according to an exemplary embodiment.

FIG. 3 shows a schematic representation of the integrated valve assembly 135 and the eductor interface 130 within the scale control tray and valve interface assembly 140, according to an exemplary embodiment. As shown, the integrated valve assembly 135 and the eductor interface 130 may be integrally formed or disposed adjacent to the scale control tray 125, which receives wastewater from a water panel 115 (e.g., similar or equivalent to the water panel 15). The eductor interface 130 includes an outlet (e.g., similar or equivalent to the outlet 76), which provides water from the integrated valve assembly 135 to water distribution conduits (e.g., similar or equivalent to the conduit 33) to subsequently supply water to the water panel 115. In an embodiment, the eductor interface 130 is formed by interfacing the integrated valve assembly 135 (and optionally a corresponding water collection member) with the scale control tray 25.

The integrated valve assembly 135 includes a combination orifice and check valve 137, which is fluidly coupled to a solenoid valve 150, where the solenoid valve 150 controls flow of pressurized fresh water from a water supply (e.g., similar or equivalent to the water source 55) into the integrated valve assembly 135. The combination orifice and check valve 137 may be an integral component of the integrated valve assembly 135 or optionally may be a separable component that separably mates with a body of the integrated valve assembly 135, for example, via threads or another separable mating component. In various embodiments, the combination orifice and check valve 137 may be a piston type check valve having a flange or sealing cap 139 that interfaces with the scale control tray 125 such that the combination orifice and check valve 137 meters water flow from the scale control tray 125 to a fluidly coupled drain collar ("drain") 160 when valve 150 is off or seals an interface between the drain collar 160 and the scale control tray 125 to allow wastewater to be drawn through the outlet of the eductor interface 130 when valve 150 is on. In other embodiments, the combination orifice and check valve 137 may be a flexible membrane or diaphragm type check valve. A spring 155 may be coupled between a portion 143 of the outlet to bias the combination orifice and check valve 137 in an open position to allow water flow to the drain collar 160 (i.e., drainage of wastewater). In various embodiments, the drain collar 160 may enclose the integrated valve assembly 135 and may be configured to connect to a drain line (e.g., similar or equivalent to the drain 45) and/or a pressure line to the valve 150, which may be remotely mounted.

In still further embodiments, the humidifying system 10 may utilize a separate orifice and check valve configuration in which the respective orifice and check valve components are not combined into a single integral component.

Accordingly, during operation of the humidifier system 10, when pressure is present within the scale control tray 125 due to water accumulation therein, water from the scale control tray 125 may flow into the integrated valve assembly 135 and engage the eductor 130 such that the received water may be redistributed to the water panel 115. When the solenoid valve 150 is in an "off" state, pressurized water from the scale control tray 125 may bleed (e.g., gravity drain) through one or more orifices of the integrated valve assembly 135 where the spring 155 (or a diaphragm, membrane, or other biasing mechanism) biases the combination orifice and check valve 137 to an "open" configuration where water can then drain through the drain collar 160. When the solenoid valve 150 is in an "on" state, fresh water may flow into the integrated valve assembly 135, where a combination of wastewater from the scale control tray 125 and fresh water from the water supply may flow through the eductor 130 to wet the water panel 115. Because the combination orifice and check valve 137 is configured as a single movable component within the integrated valve assembly 135, pressurized water may still be contained in a single solenoid-controlled feed and stagnation of water within the scale control tray 125 may be simultaneously minimized to provide a humidifier system 10 that both reduces overall water consumption, increases water flow rate to the water panel 115, and reduces (or eliminates) contaminant buildup near the eductor 130 (e.g., as compared to a system that relies on wastewater evaporation). Furthermore, the single component configuration of the combination orifice and check valve 137 reduces a number of components within the scale control tray and valve interface assembly 140, and thus a number of components within the humidifier system 10. The configuration of the humidifier system 10 also simplifies serviceability by an end user for water panel 115 replacement.

In various embodiments, a humidifier system may be configured such that a scale control tray and valve interface assembly may be separable. FIGS. 4-8 show alternate views of a humidifier system 200 having a removable integrated collection member and valve assembly 235. In an embodiment, the valve assembly portion of collection member and valve assembly 235 may be similar or equivalent to the assembly 135. The collection member and valve assembly 235 may be a single integrated component or may be a combination of a collection member and a separate valve assembly. The collection member portion of the collection member and valve assembly 235 includes an outer shell defining an interior volume with a basin for collecting and drawing wastewater. The collection member and valve assembly 235 may be configured to at least partially enclose a portion of a solenoid valve (e.g., in a manner similar or equivalent to the drain collar 160). In various embodiments, the collection member and valve assembly 235 may be couplable to the scale control tray 223 and/or a frame or shell of the humidifier via one or more fasteners 285 to create a scale control tray and valve interface assembly 240 within the region 224 of the scale control tray 223 so as to facilitate operation of the eductor 230. In the embodiment depicted in FIG. 4, the fasteners 285 are connected to a frame of the humidifier to hold the collection member and valve assembly 235 in position relative to scale control tray 223. Accordingly, the control tray and valve interface assembly 240 may be deconstructed by decoupling the collection member and valve assembly 235 from the scale control tray 223, for example by removing fasteners 285.

Figure 4:
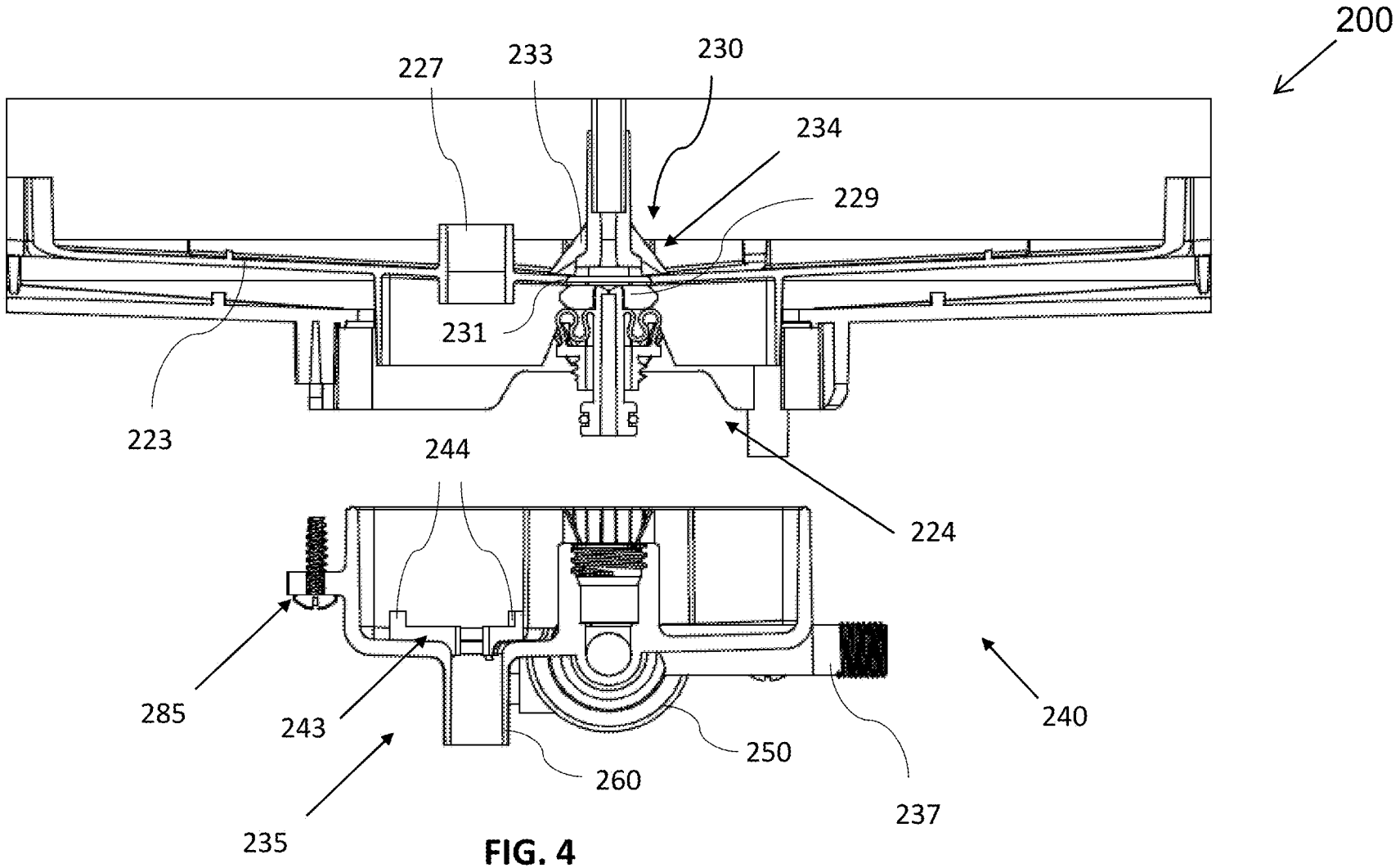
FIG. 4 is an exploded cross sectional view of a scale control try and valve interface, according to another exemplary embodiment.

As shown in FIG. 4, a scale control tray and valve interface assembly 240 (e.g., similar or equivalent to the assemblies 40, 140) is formed upon connection of collection member and valve assembly 235 to the scale control tray 223, thereby creating an eductor 230 (e.g., similar or equivalent to the eductors 30, 130). The eductor 230 includes at least one orifice 229 (e.g., an annular orifice) that is configured to reduce pressure and flow rate. In an embodiment, the orifice 229 is connected to or otherwise integrated as part of the collection member and valve assembly 235 such that the scale control tray 223 is selectively separable from the orifice 229. Additionally, in some embodiments, the orifice 229 may be included together with a check valve components to create a combination orifice and check valve as discussed further below. Upon connection of collection member and valve assembly 235 to the scale control tray 223, the orifice 229 is seated proximate a valve seat 231 of the scale control tray 223 to enable control of wastewater from the scale control tray 223, enabling operation of the eductor 230. The collection member and valve assembly 235 receives pressurized fresh water from a water source via an inlet 237, where flow of fresh water through the inlet 237 into the collection member and valve assembly 235 and ultimately through orifice 229 is controlled by a solenoid valve 250 (e.g., similar or equivalent to the solenoid valves 50, 150). A top portion of the collection member and valve assembly 235 may be configured to be received within a region 224 of a scale control tray 223 (e.g., similar or equivalent to the trays, 25, 125), where water flow from the collection member and valve assembly 235 is distributed by the eductor 230 to a fluidly coupled water panel (e.g., similar or equivalent to the water panel 15, 115).

Figure 4A:
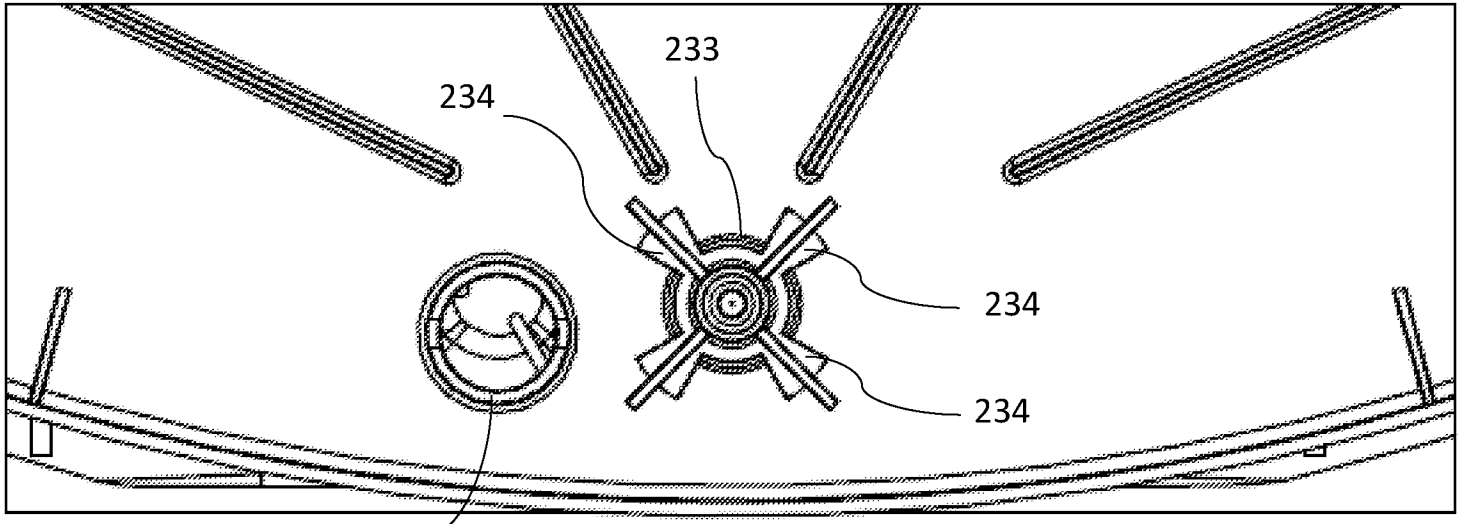
FIG. 4*a* is a top down cross sectional view of the scale control tray, according to an exemplary embodiment.

Wastewater from the water panel may be collected by the scale control tray 223, which is coupled to a bottom portion of the water panel. The eductor 230 includes at least one inlet or opening 234 through an outer wall 233 in fluid communication with the scale control tray 223 and the collection member and valve assembly 235, where wastewater from the scale control tray 223 either drains into the collection member and valve assembly 235 or flows through an interior volume of the eductor 230 (as controlled by the collection member and valve assembly 235) to be redistributed to the water panel. FIG. 4*a* depicts a top down cross-sectional view of the scale control tray 230 in which multiple inlets or openings 234 are depicted, which provide a path for water to move from a basis of the scale control tray 223 into an interior volume of the eductor 230.

The outer wall 233 of the eductor 230 defines an interior volume that forms a venturi pump upon the combination of pressurized water through the orifice 229 and wastewater from the scale control tray 223 received through the inlet(s) in the outer wall 233. When the wastewater within a basin of the scale control tray 223 reaches an overflow level, the wastewater may flow through an overflow outlet 227 into a basin of the removable integrated collection member and valve assembly 235. Wastewater from the overflow outlet 227 is drained away from a basin of the collection member and valve assembly 235 through the drain outlet 260. The collection member and valve assembly 235 may include a drain spud that is in fluid communication with a conduit or water flow channel through the collection member and valve assembly 235 to route drain water toward a drain outlet 260. The collection member and valve assembly 235 may further include a cleaning tablet holder 243 configured to position a drain cleaning tablet to facilitate cleaning of the drain and other components of the humidification system. For example, cleaning tablet holder 243 may be positioned such that it is located within the flow of drain water passing from overflow outlet 227 through the basin of collection member and valve assembly 235 to drain outlet 260 so as to facilitate more efficient dissolving of the cleaning tablet. In various embodiments, the cleaning tablet holder 243 includes one or more rib members 244 extending upward from a bottom of the basin of the collection member and valve assembly 235 to hold a cleaning tablet off of the bottom of the basin.

Figure 5:
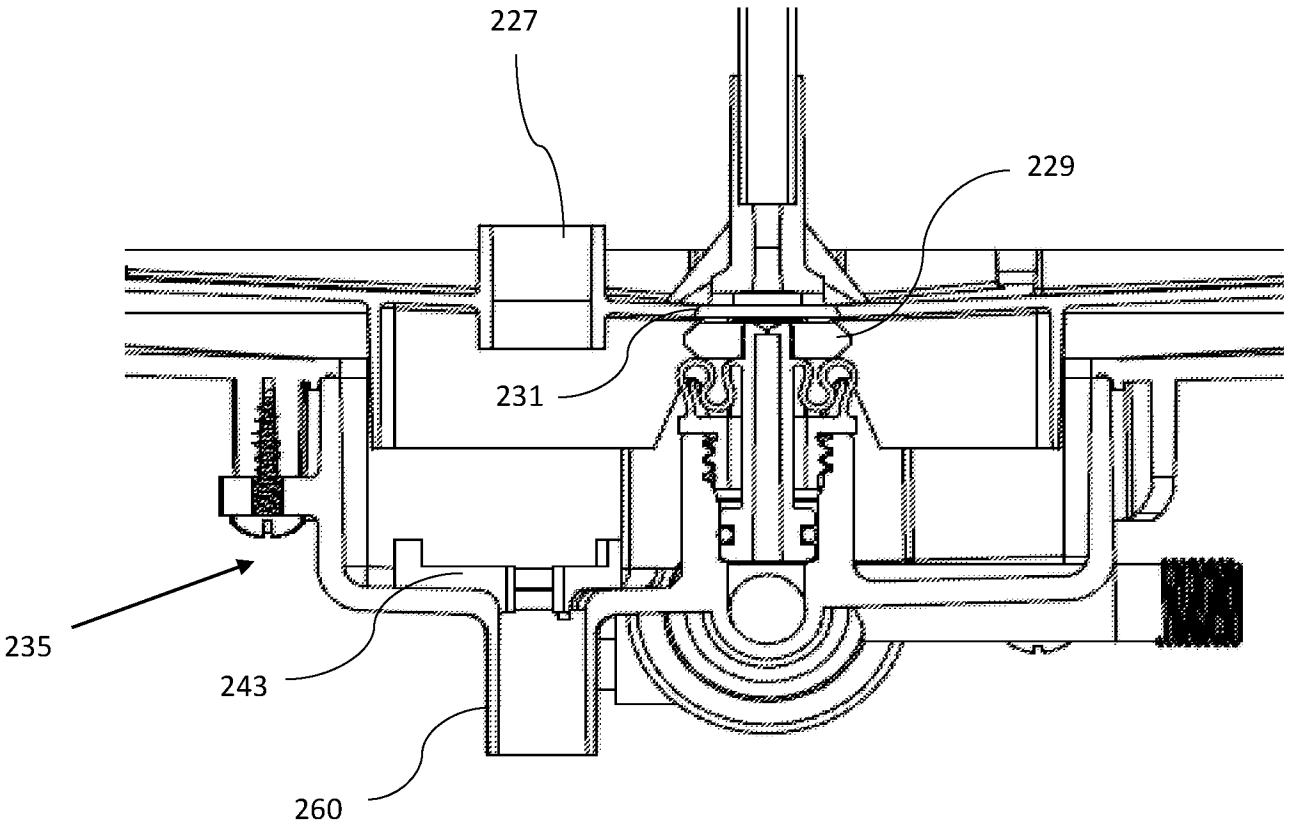
FIG. 5 is a cross sectional view of the scale control tray and valve interface, according to an embodiment in which an orifice of the valve assembly is positioned in a drain configuration.
Figure 6:
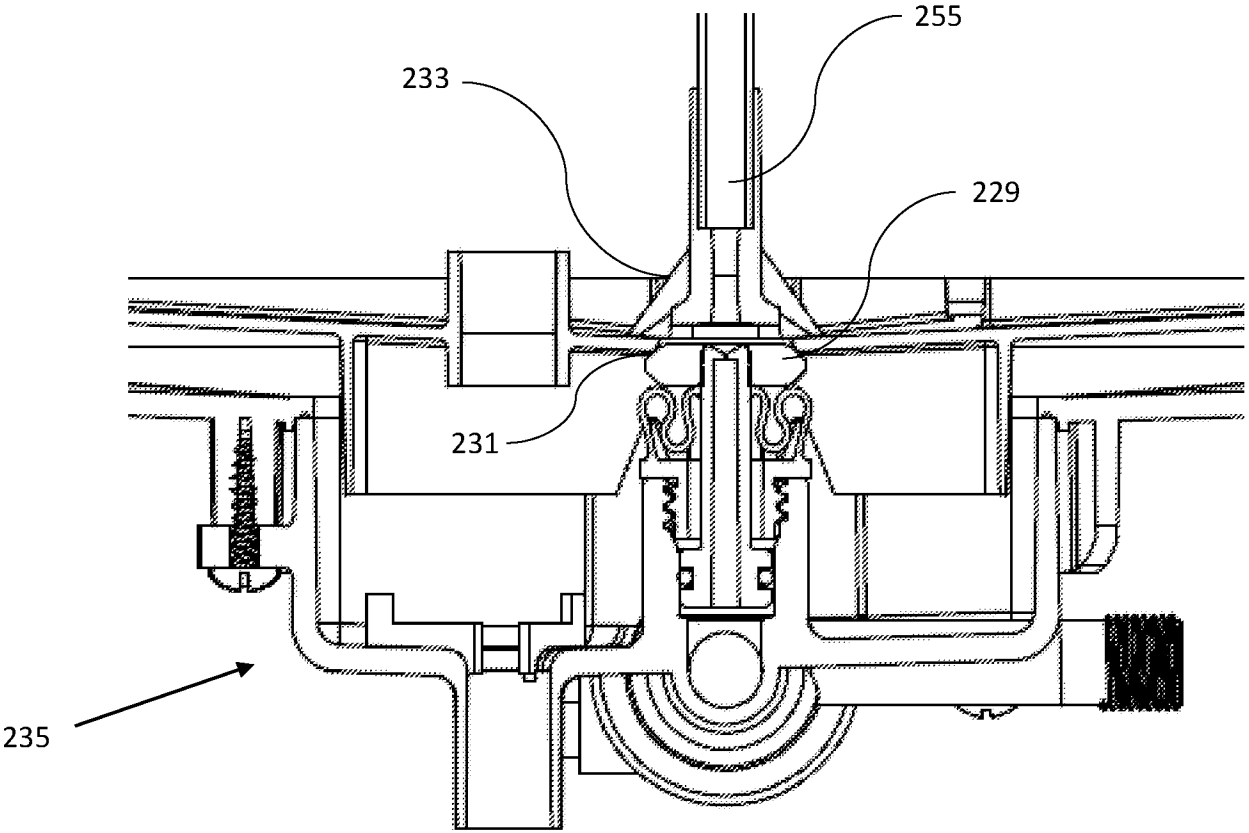
FIG. 6 is a cross sectional view of the scale control tray and valve interface, according to an embodiment in which the orifice of the valve assembly is positioned in an operational humidification configuration.

FIG. 5 depicts the orifice 229 positioned in a drain configuration such that the orifice 229 and/or a corresponding valve seal is spaced apart from valve seat 231 enabling wastewater from the scale control 223 to flow through a gap between the orifice 229 and the valve seat 231 and into a basin of the collection member and valve assembly 235 to be drained through drain outlet 260. FIG. 6 depicts the orifice 229 positioned in an operation humidification configuration in which the orifice 229 is firmly seating against the valve seat 231 enabling wastewater from the scale control 223 to flow through inlets in outer wall 233 and be combined with pressurized water from through a central opening in orifice 229 (e.g., forming a venturi pump) and pushed through outlet 255 of eductor 30 to be routed back to the distribution tray and through the humidifier pad.

Figure 8:
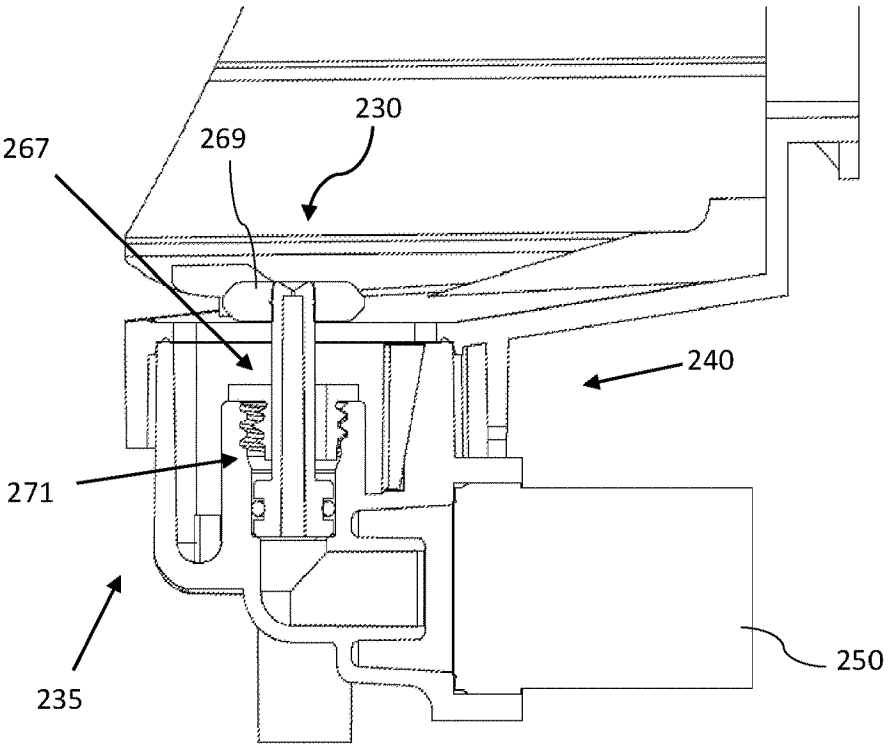
FIG. 8 is a cross sectional view of the scale control tray and valve interface of FIG. 5, according to an exemplary embodiment.
Figure 7:
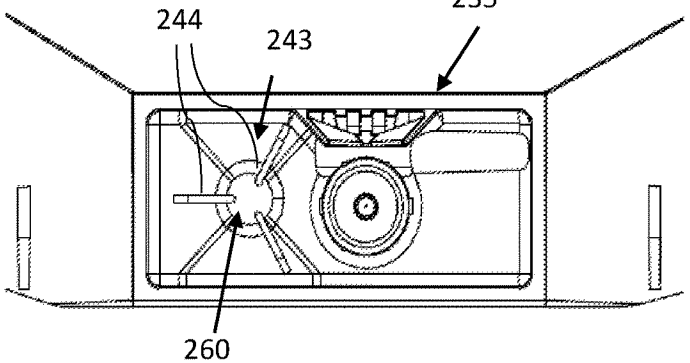
FIG. 7 is a schematic representation of a top view of the valve interface and overflow port with drain tray of FIG. 5, according to an exemplary embodiment.

FIG. 7 is a schematic representation of a top view of the collection member and valve assembly 235 of FIGS. 5 and 6, according to an exemplary embodiment. FIG. 8 depicts the collection member and valve assembly 235 coupled to the scale control tray 223 to form the scale control tray and valve interface assembly 240. The collection member and valve assembly 235 is configured such that a surface (e.g., sealing flange) 269 of a combination orifice and check valve 267 (e.g., similar or equivalent to the combination orifice and check valve 137) is disposed to form a seal with a surface (e.g., a valve seat) of the scale control tray 223 to control water flow into the eductor 230 or into the drain outlet 260 in a similar manner as described above. In some embodiments, a spring (e.g., similar or equivalent to the spring 155) may be disposed between the combination orifice and check valve 267 to bias the combination orifice and check valve 267 open such that wastewater from the scale control tray 223 may be combined with fresh water and redistributed to the water panel when the solenoid valve 250 is on, or wastewater from the scale control tray 223 drain away (i.e., via the conduit 243) when the solenoid valve 250 is off. The combination orifice and check valve 267 may be removably coupled to (or otherwise integrated as one piece with) a body of the collection member and valve assembly 235, for example by a thread mechanism 271 or another suitable mechanism. As such, upon separation of the scale control tray 223 from the collection member and valve assembly 235, the combination orifice and check valve 267 will be separated from the corresponding valve seat on the scale control tray 223, thereby enabling selective removal and/or replacement of either the scale control tray 223 or the collection member and valve assembly 235. The foregoing manner of interfacing the scale control tray 223 and the collection member and valve assembly 235 also enables selective removal of the scale control tray 223 (e.g., for servicing, etc.) without necessarily removing the collection member and valve assembly 235.

Figure 8A:
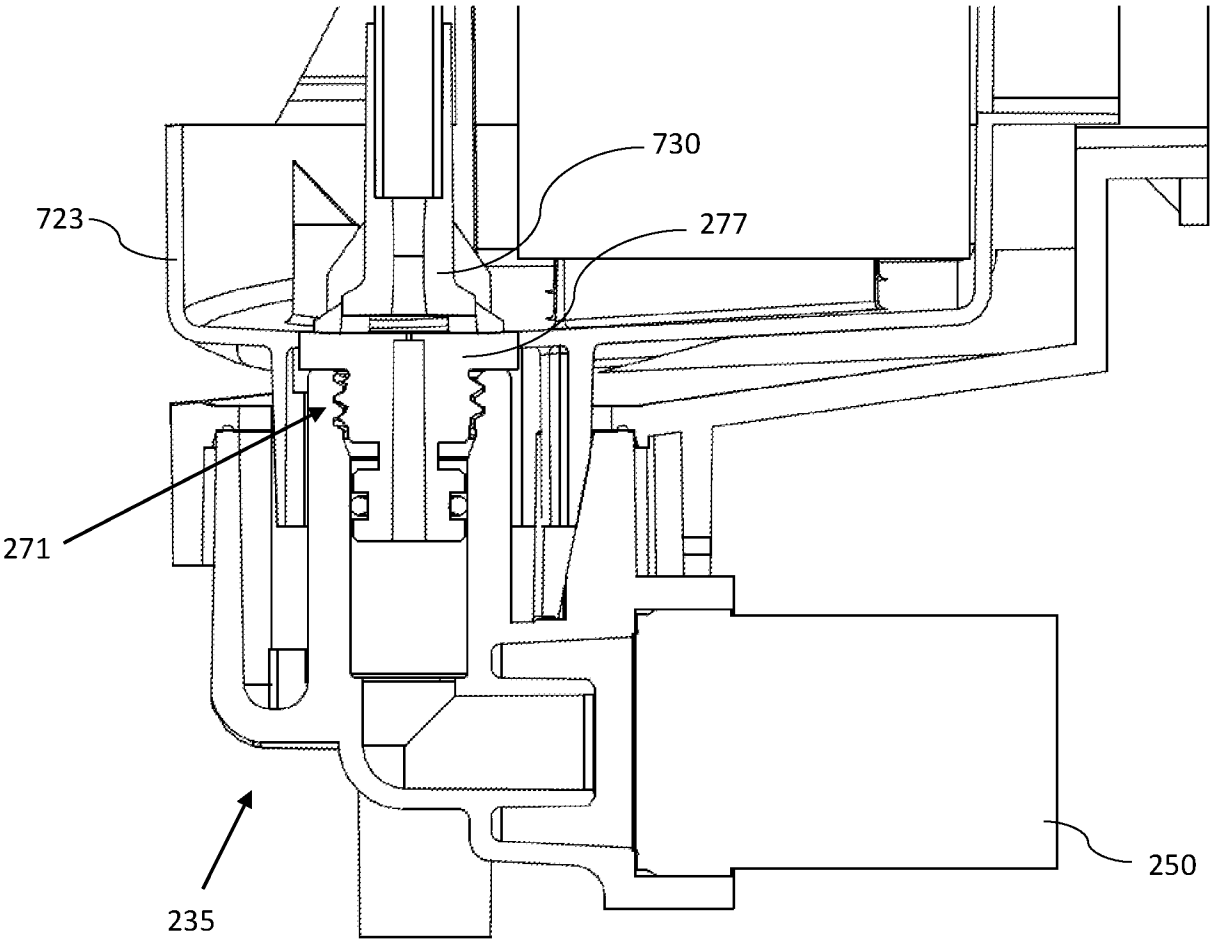
FIG. 8*a* is a cross sectional view of a scale control tray and valve according to another embodiment.

In other embodiments, eductor 730 may be formed separate from the scale control tray 723 (as compared to other embodiments in which the eductor 730 may be formed by the interface between the scale control tray 723 and the collection member and the valve assembly 235). FIG. 8*a* depicts such a configuration in which the collection member and valve assembly 235 is coupled to the scale control tray 723 to form the scale control tray and valve interface assembly 240. The collection member and valve assembly 235 is configured such that a surface of an orifice 277 is disposed adjacent to and forms a seal with an eductor 730. In alternative embodiments, a combination orifice and check valve as disclosed herein may be used in place of orifice 277 or a separate orifice and check valves may alternatively be used. The orifice 277 may be removably coupled to (or otherwise integrated as one piece with) a body of the collection member and valve assembly 235, for example by a thread mechanism 271 or another suitable mechanism. The eductor 730 is a separate component from the scale control tray 723. The scale control tray 723 includes an opening to receive the eductor 730 such that upon assembly, the scale control tray 723 is positioned over the eductor 730 and the eductor 730 is received within the opening. A radial or axial face seal is formed between the scale control tray 723 and the eductor 730. Openings through an outer wall of the eductor 730 facilitate water flow from a basin of the scale control tray 723 in a similar manner as described in the various embodiments above. Likewise, fresh water is supplied into the eductor 730 through the orifice 277 and the collection member and valve assembly 235 in a similar manner as described above.

Figure 9:
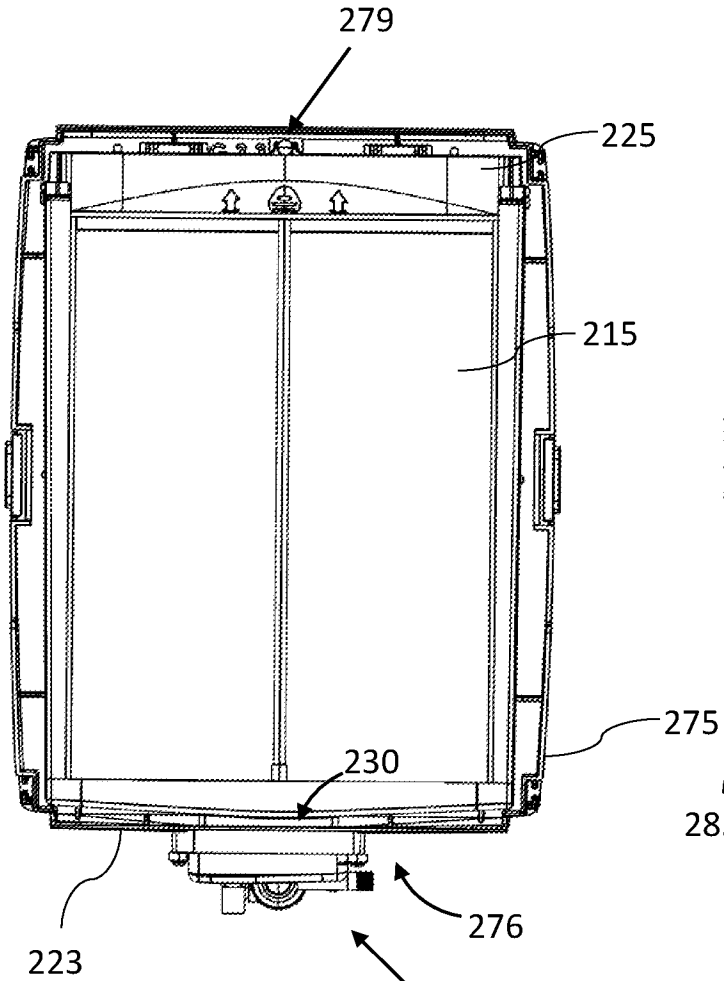
FIG. 9 is a schematic representation of a humidifier having a removable valve interface and eductor module, according to an exemplary embodiment.

FIG. 9 depicts a water panel 215, the scale control tray 223, and a distribution tray 225 (e.g., similar or equivalent to the distribution tray 20) housed within a base 275 (or frame) having an eductor 230. In various embodiments, the collection member and valve assembly 235 may be couplable at multiple points within the humidifier system 200. When coupled to the base 275 and/or scale control tray 223, the collection member and valve assembly 235 creates the scale control tray and valve interface assembly 240 and forms an eductor 230 disposed at a first end 276. Accordingly, the scale control tray and valve interface assembly 240 may be interchangeably connected to either a front or back of the water panel 215 to facilitate ease of assembly of the humidifying system 200.

Figure 10:
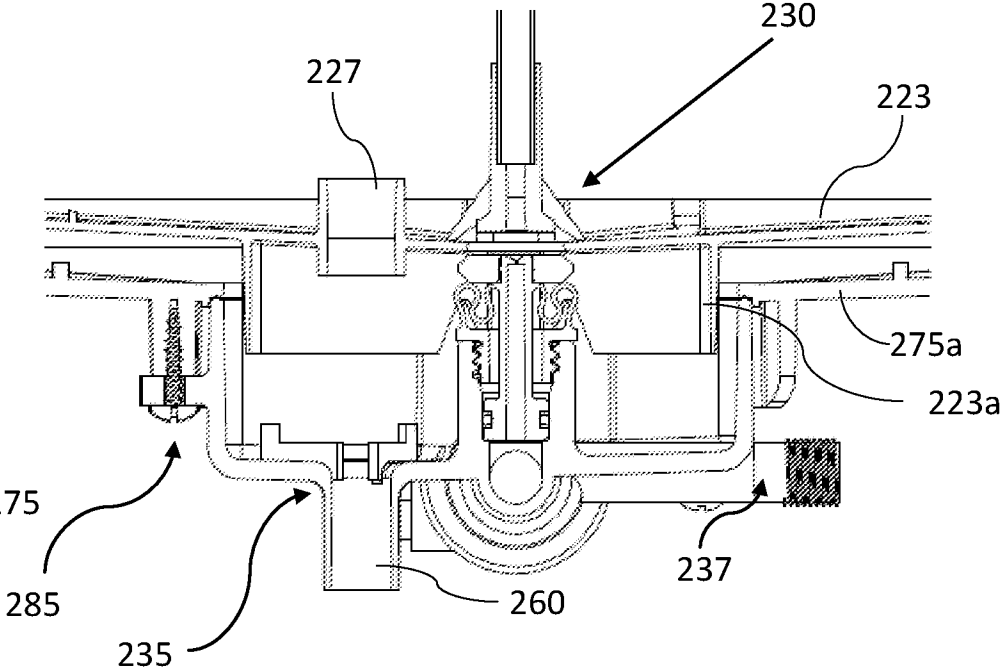
FIG. 10 is a schematic representation of a side cross-sectional view of the valve interface and eductor module of FIG. 9, according to an exemplary embodiment.
Figure 10A:
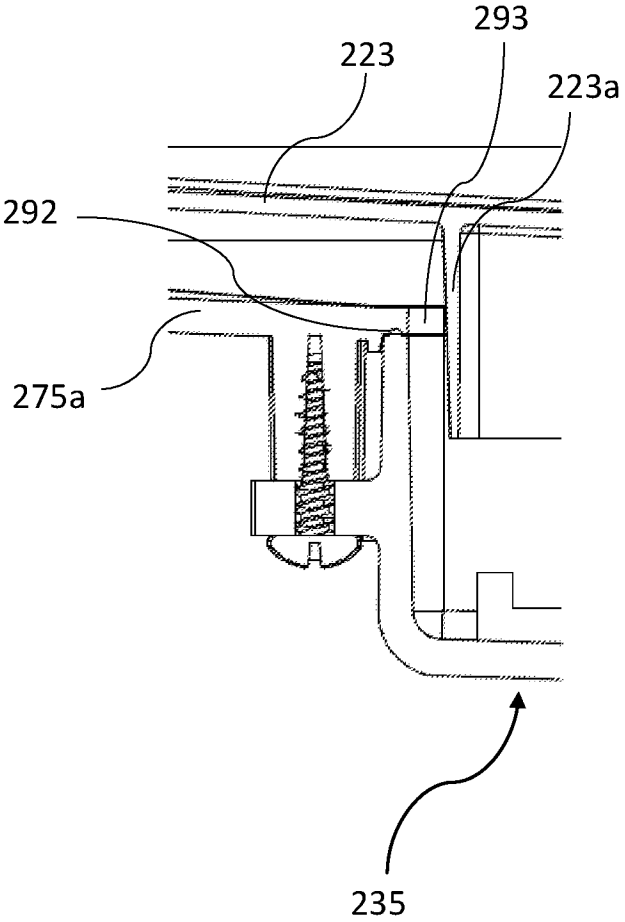
FIG. 10*a* is a schematic representation of a cross-sectional vie of the valve interface and eductor module of FIG. 9, according to an exemplary embodiment having a drain channel for draining water from the humidifier frame.
Figure 12:
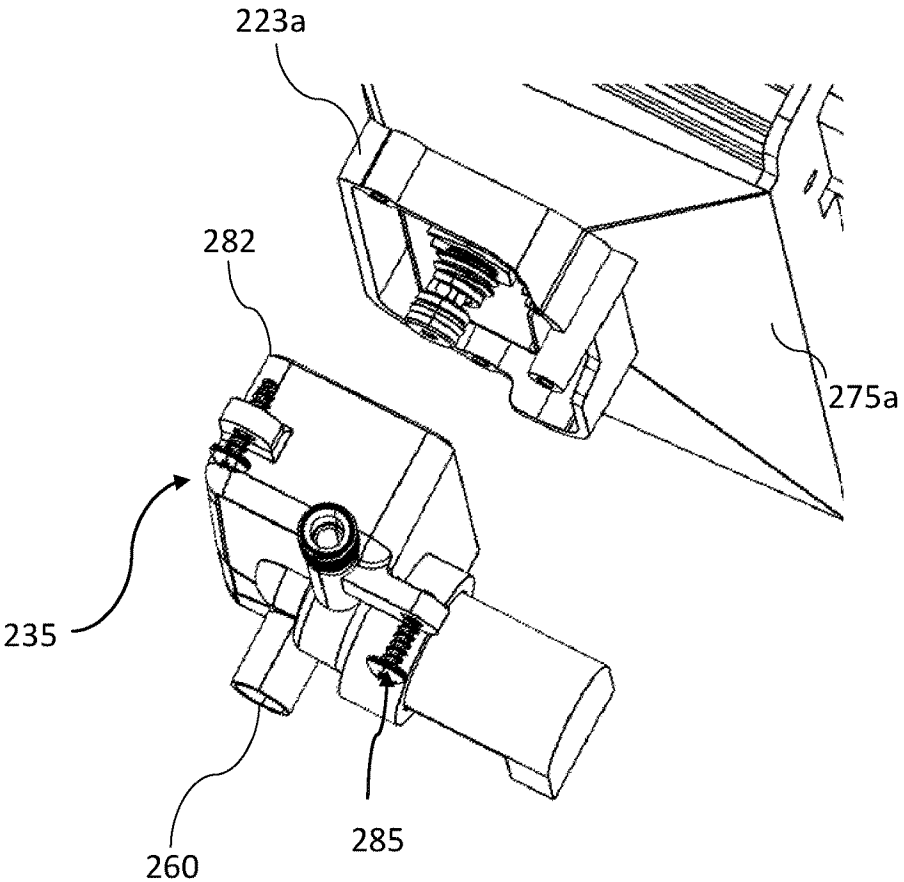
FIG. 12 is a schematic representation of a perspective view of the humidifier and valve interface and eductor module of FIG. 9 near a coupling region, according to an exemplary embodiment.
Figure 11:
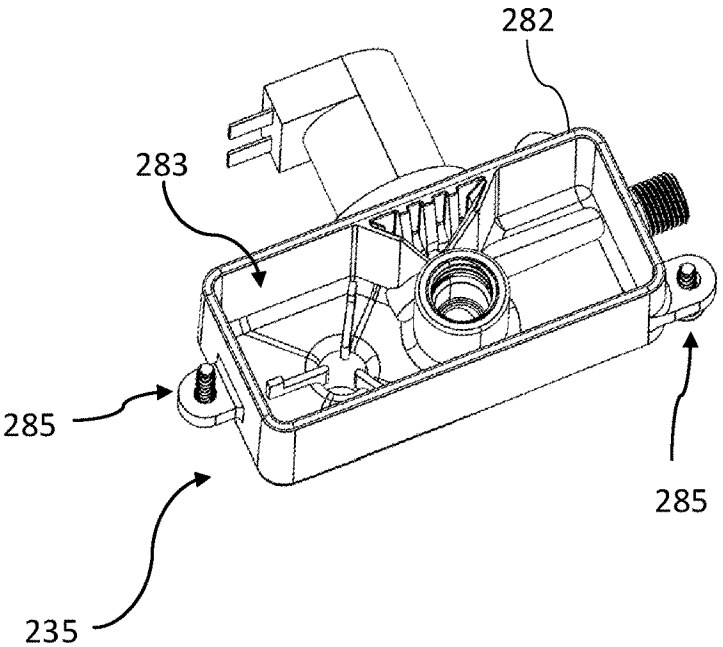
FIG. 11 is a schematic representation of a perspective view of a drain spud within the valve interface and eductor module of FIG. 9, according to an exemplary embodiment.

As shown in FIG. 10, the collection member and valve assembly 235 may be configured such that connection and removal of the collection member and valve assembly 235 from the base 275 and/or the scale control tray 223 requires only coupling and decoupling a retention mechanism 285 (e.g., one or more fasteners, rails, etc.) of the collection member and valve assembly 235 from the scale control tray 223 or another structural mating component of the base 275. In various embodiments, the collection member and valve assembly 235 includes a body having a structure complementary to a structure of the base 275 such that an upper edge 282 of the body is configured to interface or engage with an end of the base 275 to facilitate connection of the collection member and valve assembly 235 to the base 275, as shown in FIGS. 10*a*, 11, and 12. In various embodiments, the upper edge 282 is configured to be positioned around an end portion 275*a* of the base 275 (or alternatively, an end portion 223*a* of the scale control tray 223—see, e.g., FIG. 10) such that the end portion 275*a* of the base 275 or the end portion 223*a* of the scale control tray 223 extends within an interior volume of the collection member and valve assembly 235. In certain embodiments, the scale control tray 223 may extend through an opening in the base 275, thereby creating an extension that may mate with the collection member and valve assembly 235. Such a configuration allows for draining of moisture or splashover water that accumulates outside of the scale control tray 223 on the base 275 into the basin and ultimately the drain outlet 260 of the collection member and valve assembly 235. In other embodiments, alternative coupling mechanisms may be used to couple the collection member and valve assembly 235 to the base 275 and/or the scale control tray 223 including for example a rail system, latches, or any other suitable coupling mechanism or component known to those in the art. FIG. 10*a* depicts such a configuration in which a seal 292 is formed between the upper edge 282 of the body of the collection member and valve assembly 235 and the end portion 275*a* of the base 275 such that water on the upper side of the base 275 may drain into the basin of the collection member and valve assembly 235 via a channel 293 formed between the interior of the sidewall of the collection member and valve assembly 235 and the end portion 223*a* of the scale control tray 223.

In various embodiments, the overflow outlet 227 may be combined or fluidly connected to a conduit draining away from the collection member and valve assembly 235 (e.g., via the combination orifice and check valve 267) such that humidifying system 200 includes a single drainage passageway or conduit for wastewater flow away from the system 200. In various embodiments, the collection member and valve assembly 235 (e.g., via the combination orifice and check valve 267) may be controllable (e.g., manually or automatically via an operably coupled controller) to allow complete and total drainage of wastewater from the scale control tray 223, which may facilitate eliminating or minimizing scale buildup within the scale control tray 223 over time by not relying solely on wastewater evaporation from the scale control tray 223. Reducing dependency on wastewater evaporation from within the scale control tray 223 reduces likelihood of solids or other contaminants (including scale buildup) accumulating or circulating within the humidifier system 200, which may diminish the operational life of the humidifier system 200.

Figure 14:
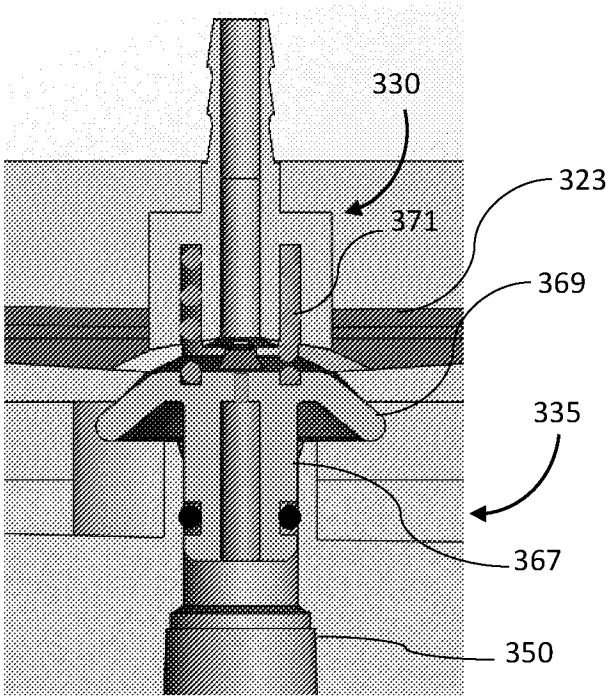
FIG. 14 is a schematic representation of a cross-sectional view of the eductor and drain/orifice check valve of FIG. 13, according to an exemplary embodiment.
Figure 13:
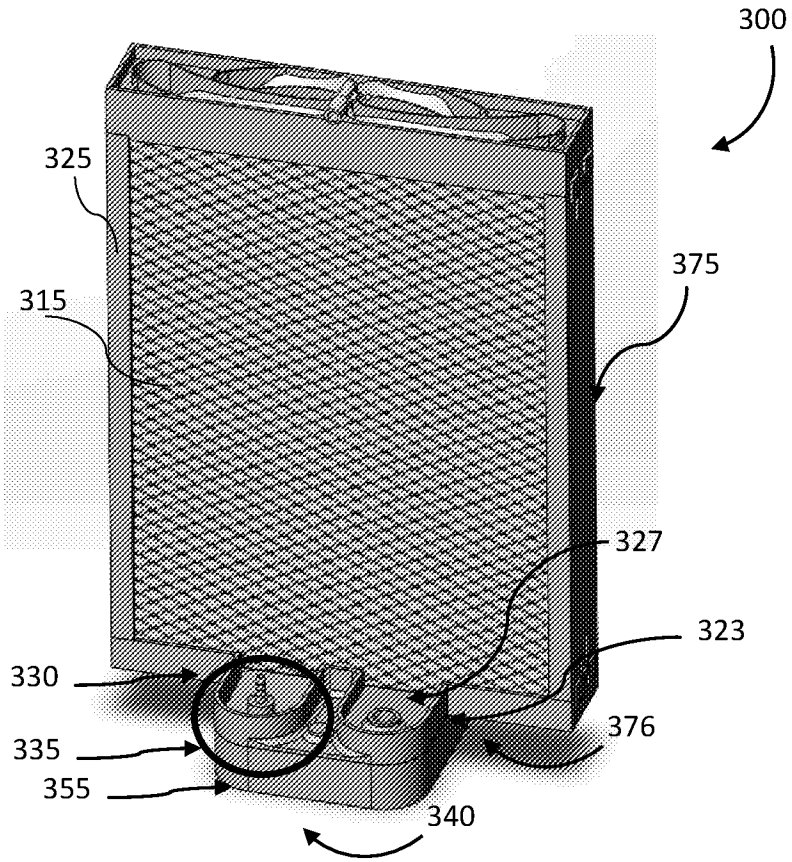
FIG. 13 is a perspective view of a humidifier having a valve interface and eductor module, according to another exemplary embodiment.

In other embodiments, the scale control tray and valve interface assembly may be integrally formed with a base of the humidifier system, and a water panel may be removably couplable thereto to facilitate ease of assembly and replacement of the water panel. FIG. 13 shows a perspective view of a humidifying system 300, according to an exemplary embodiment, and FIG. 14 shows a cross-sectional view of the integrated valve assembly 335 of FIG. 13, according to an exemplary embodiment. Elements 300-376 of the humidifying system 300 are similar or equivalent to corresponding elements 200-276 of the humidifying system 200. As shown in FIG. 13, the scale control tray and valve interface assembly 340 may be disposed near a bottom portion of the base 375 and water panel 315. Accordingly, the integrated valve assembly 335 may be integrally formed with the scale control tray 323 such that wastewater from the drain 327 is alternately routed through the integrated valve assembly 335 to the eductor 330 or drained away from the system 300 based on a position of the combination orifice and check valve 367, where the position of the combination orifice and check valve 367 is determined by an on/off condition of the solenoid valve 350 and the spring 371.

Figure 17:
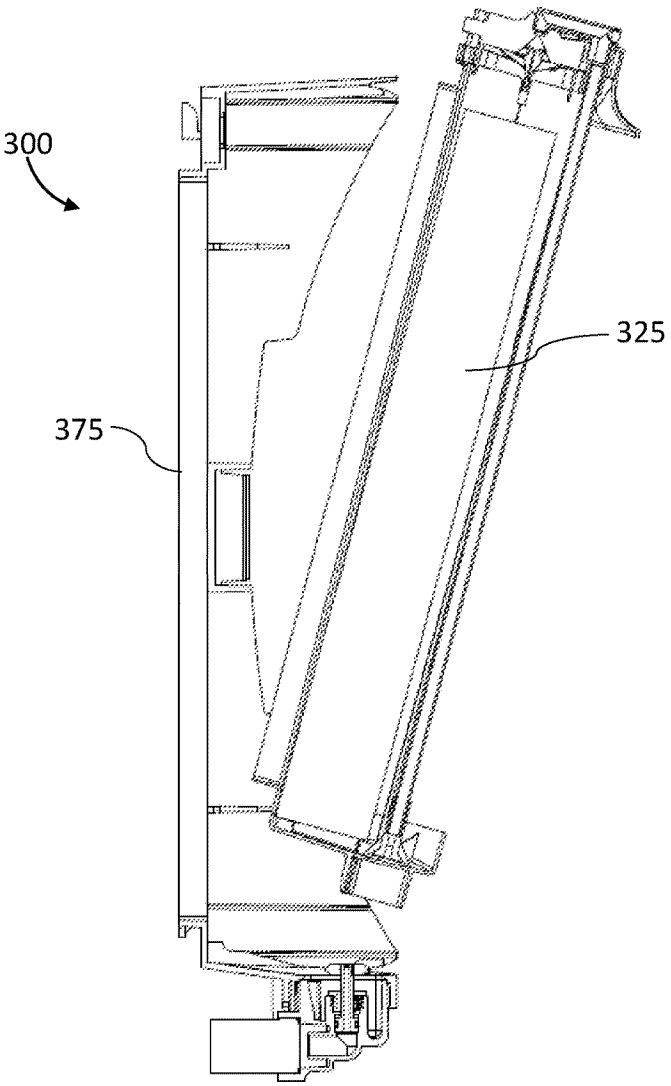
FIG. 17 is a schematic representation of a side view of the humidifier of FIG. 13 depicting a pivotably removable drain tray, according to an exemplary embodiment.
Figure 15:
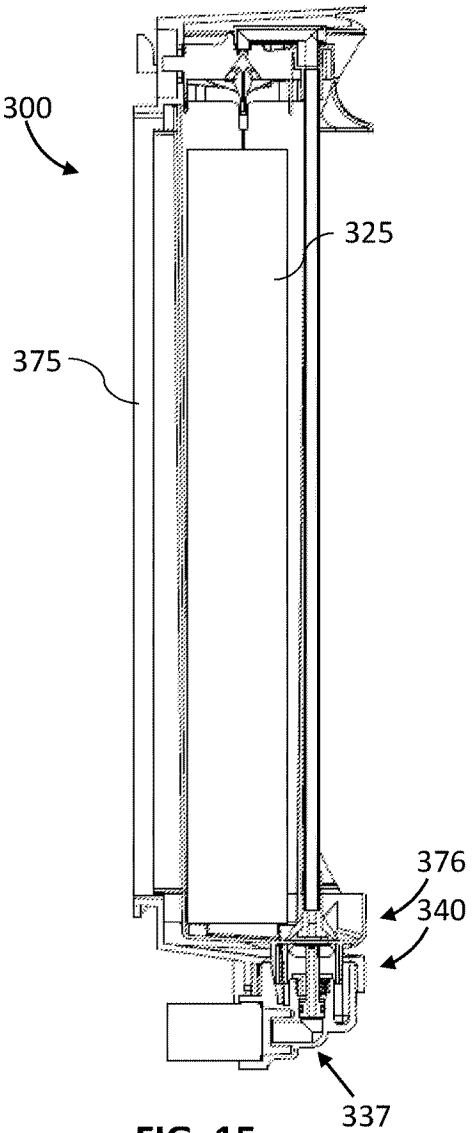
FIG. 15 is a schematic representation of a side view of the humidifier having a valve interface and eductor module of FIG. 13 incorporated into a frame common to the base mounting of the overall humidifier, according to an exemplary embodiment.
Figure 16:
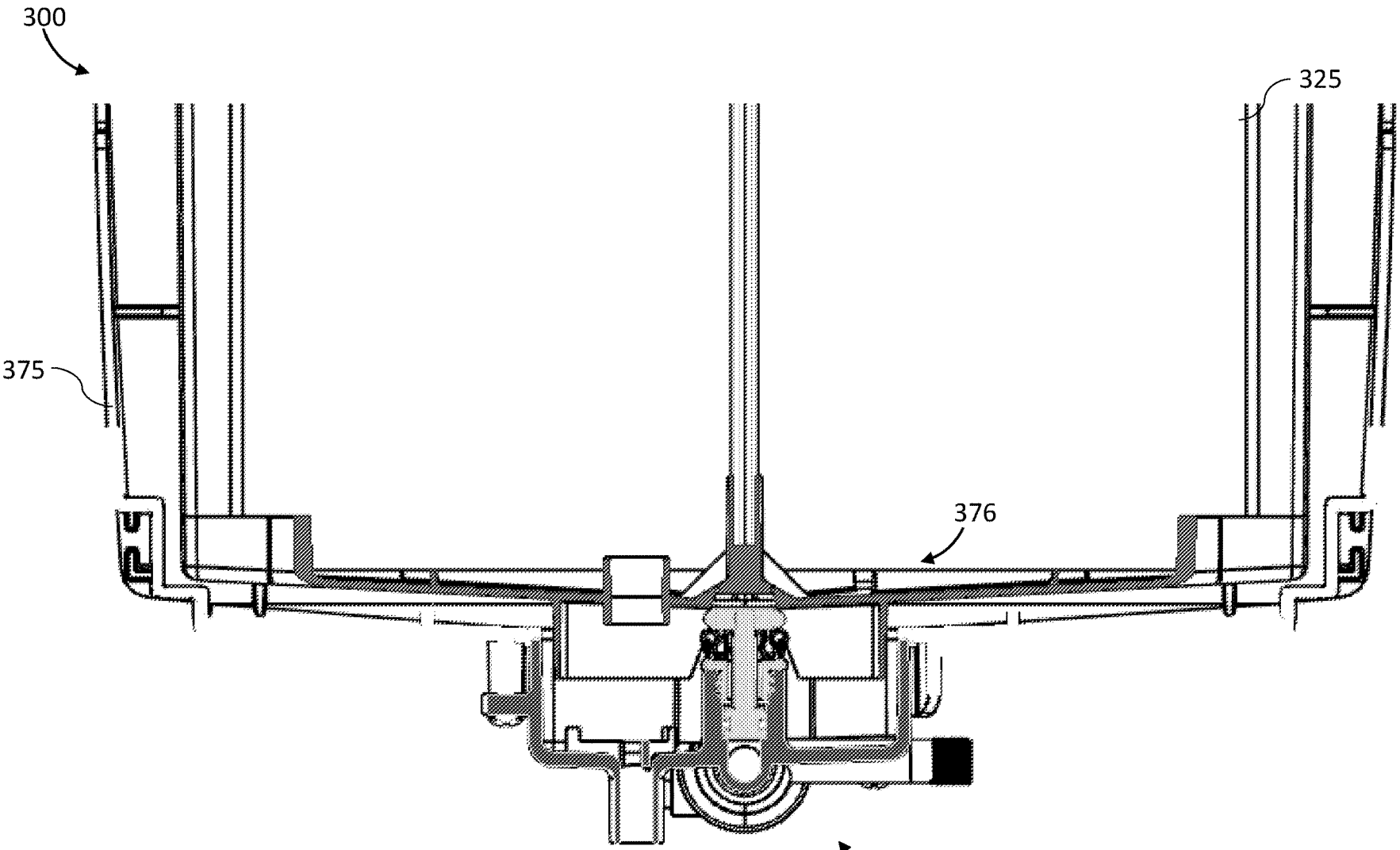
FIG. 16 is a schematic representation of a front view of the humidifier of FIG. 13, incorporated into a frame common to the base mounting of the overall humidifier according to an exemplary embodiment.

With the integrated configuration of the scale control tray and valve interface assembly 340 and the base 375, disassembly of the humidifying system 300 (e.g., to replace the water panel 315) may be facilitated by pivotable connection between the water panel 315 (enclosed within the distribution tray 325) and base 375. FIGS. 15 and 16 show the humidifying system 300 in an assembled configuration, where the water panel 315 and shell (which may optionally further include a distribution tray) 325 are fluidly coupled to the scale control tray and valve interface assembly 340 at the end 376 of the base 375. FIG. 17 shows the humidifying system 300 in a disassembled configuration, where the water panel 315 and shell 325 are fluidly decoupled from the scale control tray and valve interface assembly 340. In various embodiments, decoupling the water panel 315 and distribution tray 325 includes pivoting the water panel 315 and distribution tray 325 about the end 376 to dislodge the water panel 315 and distribution tray 325 from the base 375. In another embodiment, a top portion of the water panel 315 may be first coupled to a portion of the shell 325 (or to a portion of the base 375) and spring loaded (i.e., in a downward direction relative to the top portion of the water panel 315) onto the scale control tray and valve interface assembly 340.

Figure 18:
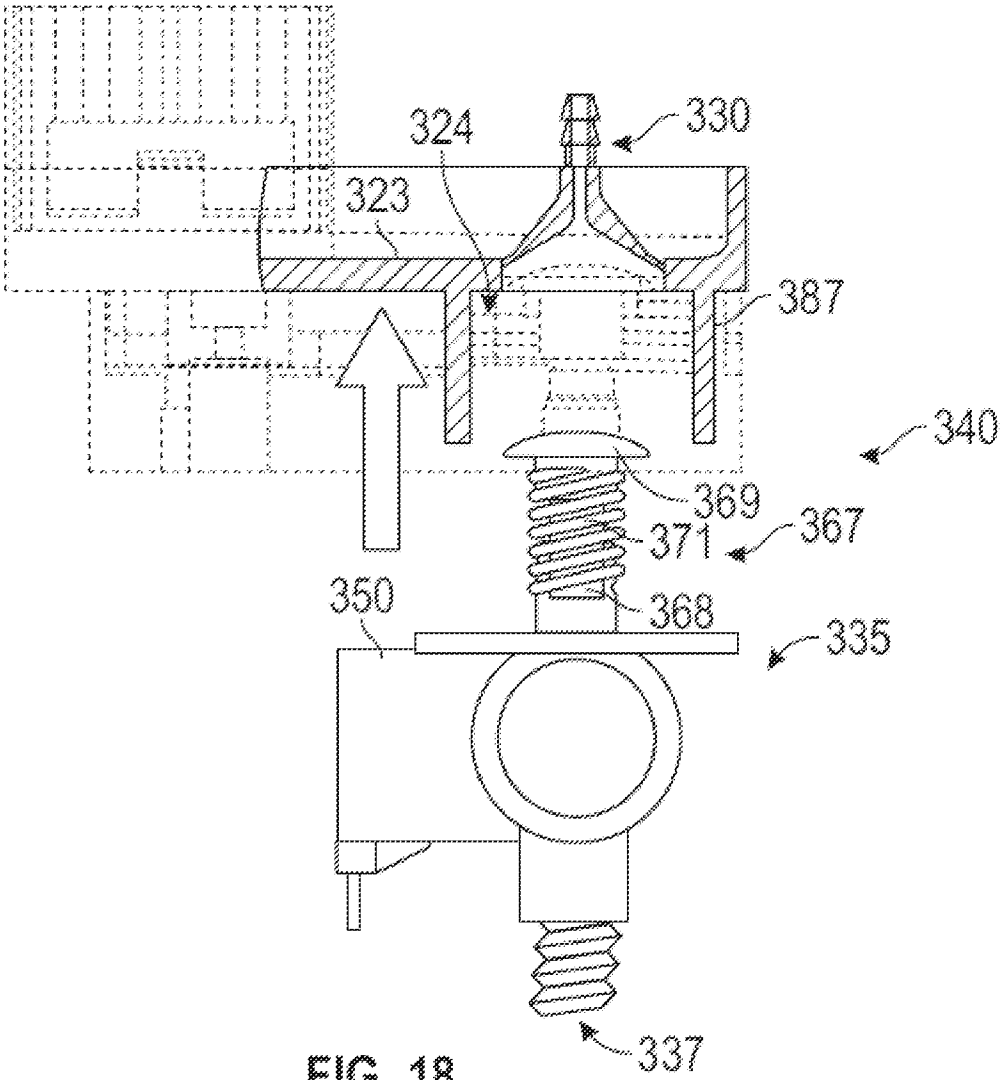
FIG. 18 is a schematic cross sectional representation of a side view of the valve interface and eductor module of FIG. 13, according to an exemplary embodiment.
Figure 19:
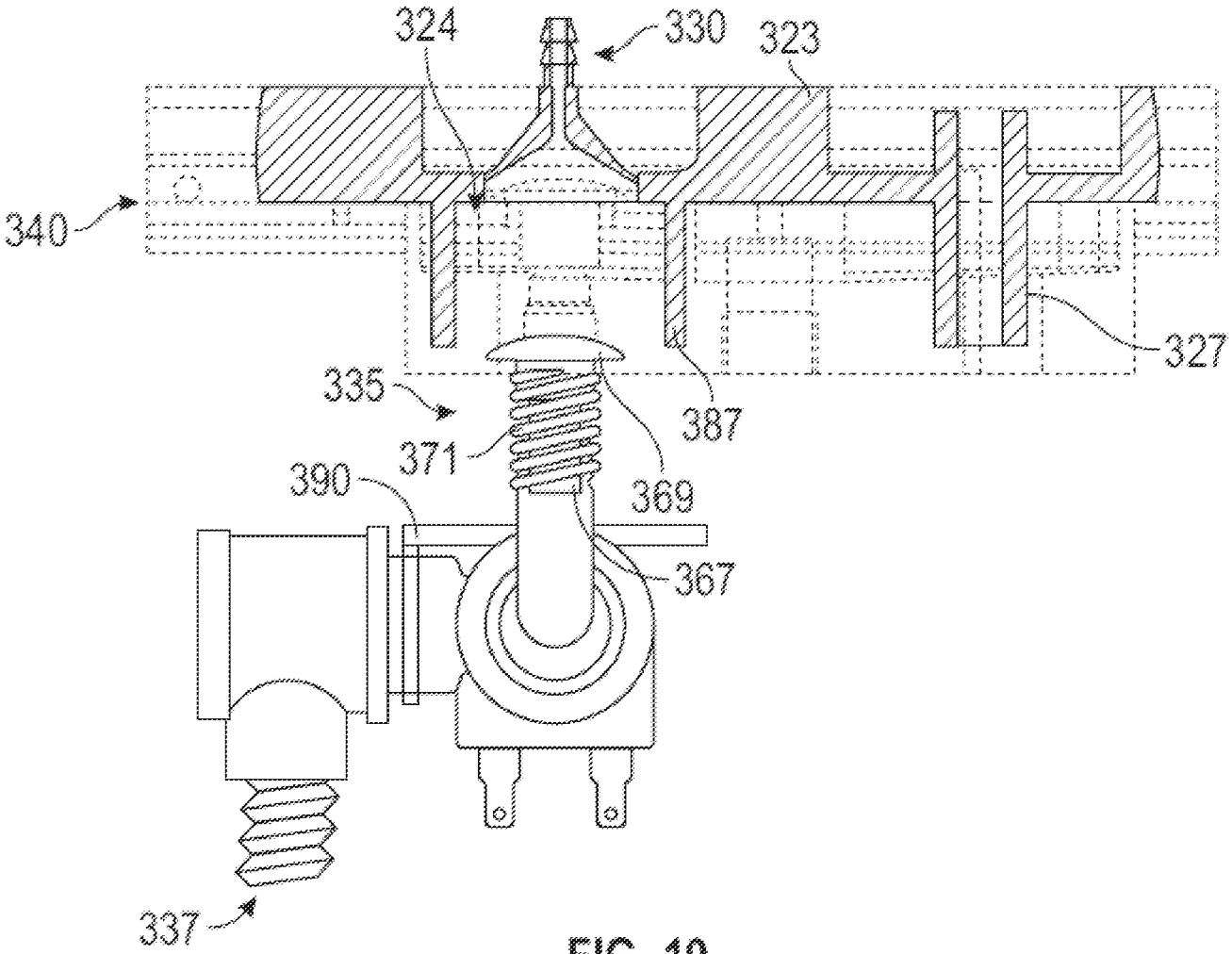
FIG. 19 is a schematic representation of a front view of the valve interface, overflow and eductor module of FIG. 13, according to an exemplary embodiment.

As previously described the scale control tray and valve interface assembly 340 may be configured such that the integrated valve assembly 335 includes a piston type combined orifice and check valve 367. In various embodiments, changing out the water panel 315 and/or scale control tray 323 may include attaching the combination orifice and check valve 367 to the body of the valve 350 via an extension spring. Accordingly, as shown in FIGS. 18 and 19, the spring 371, which may be wrapped around (i.e., concentrically placed around) a piston 368 of the check valve 367, may be an extension spring, which may be threaded on to the valve 350 and the combination orifice and check valve 367, where the extension spring is pitch matched with threading on the valves 350 and/or 367 (e.g., threaded inserts/bolts for extension springs). However, the extension spring can also be a compression spring and located on a top side of the combination orifice and check valve 367, where the compression spring pushes against a surface 387 within the region 324 of the scale control tray 323 to bias the combination and check valve 367 open (i.e., to allow drainage of wastewater). In various embodiments, the integrated valve assembly 335 may also include at least one sealing and piloting locating flange 390 disposed near or adjacent to the solenoid valve 350 to fluidly seal and facilitate locating or coupling the integrated valve assembly 335 with a top portion of the eductor 330 and/or the scale control tray 323. The check valve 367 also includes a flange or sealing cap 369, which forms a seal with a surface of the scale control tray 323 to control water flow into the eductor 330 or into the drain outlet 360.

In some implementations, water supply to the humidifying system (e.g., humidifying system 300) may be in a range of approximately 20-120 psi, which may result in forces up to approximately 18 lb within the valve interface assembly 340. In various embodiments, counteracting such forces may be accomplished by preloading various portions of the valve interface assembly 340 (e.g., via hooks, detents, etc.) during installation. However, such preloading may result in unfavorable stress distributions throughout the valve interface assembly 340 and/or adjacent components. Accordingly, it may be advantageous to transfer load carrying to a mechanical stop within the valve interface assembly 340.

Figure 20:
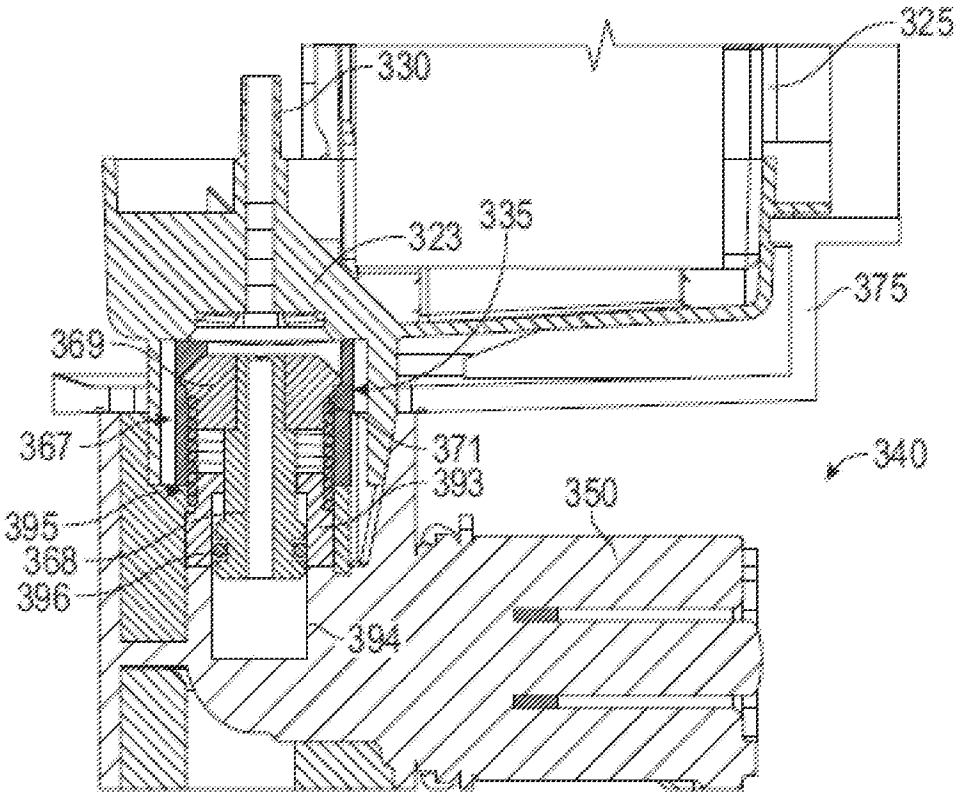
FIG. 20 is a side cross-sectional view of the valve interface of the humidifier of FIG. 13, which includes a spin weld outlet plug, according to an exemplary embodiment.

As shown in FIG. 20, the humidifying assembly 300 may be structured such that the combination orifice and check valve 367 is arranged within the valve interface assembly 340 to articulate within a conduit 394, which is fluidly coupled to the solenoid valve 350, where flow through the conduit 394 is controlled by the solenoid valve 350 and/or the combination orifice check valve 367. As shown, the combination orifice and check valve 367 may include a spring 371, which biases the combination orifice and check valve 367 away from the scale control tray 323 such that the check valve 367 remains in an open position. When the check valve 367 is in a closed position, it forms a seal between a surface of the scale control tray 323 and the flange or sealing cap 369. The piston 368 of the combination orifice and check valve 367 may extend into a cap (e.g., threaded, spin welded, friction welded) or outlet plug 393, which is disposed concentrically with the conduit 394 and which may form a mechanical stop for the combination orifice and check valve 367 to enable load transfer within the valve interface assembly 340. The valve interface assembly 340 may be structured such that the piston 368 of the combination orifice and check valve 367 is pre-installed into a bore of the cap 393. As shown, the piston 368 may include one or more seals, such as at least one o-ring 396, disposed at an end of the piston 368. Accordingly, the at least one o-ring may form a seal between the piston 368 and an inner surface of the cap 393.

Figure 21:
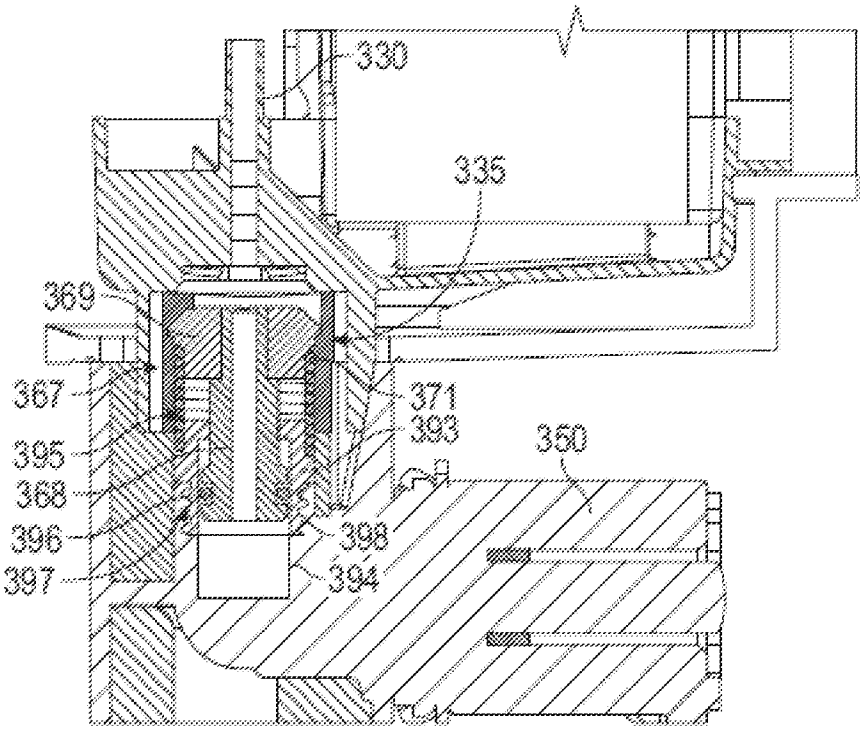
FIG. 21 is a side cross-sectional view of the valve interface of the humidifier of FIG. 13, which includes a threaded outlet plug, according to an exemplary embodiment.

To retain relative positioning of the cap 393 and the combination orifice and check valve 367, the cap 393 may include one or more features to facilitate coupling within the valve interface assembly 340. As shown in FIGS. 20 and 21, the spring 371 may be arranged within the valve interface assembly 340 to be threaded onto a top portion 395 of the cap 393. To further secure the cap 393 within the valve interface assembly 340, the cap 393 may additionally or alternatively be threadably coupled to (e.g., within) the conduit 394. For example, as shown in FIG. 21, a bottom portion 397 of the cap 393 may include one or more threads 398 that may engage with an interior surface of the conduit 394. Furthermore, by securing the cap 393 within the valve interface assembly 340, the cap 393 may support transferred loads from the spring 371 and/or the combination orifice and check valve 367.

In yet other embodiments, the combination orifice and check valve 367, the cap 393, and the spring 371 may be combined into a single component to mitigate complexity, and reduce both cost of parts and labor required for assembly. A combination check valve, orifice, spring, and plug, or flow control component 400 is shown in FIGS. 22-27. The flow control component 400 may be structured to fit within the humidifying system 300 (or additionally or alternatively the humidifying systems 10 or 200) to replace each of the combination orifice and check valve 367, the cap 393, and the spring 371 (or respective components within the humidifying systems 10 or 200).

Figure 22:
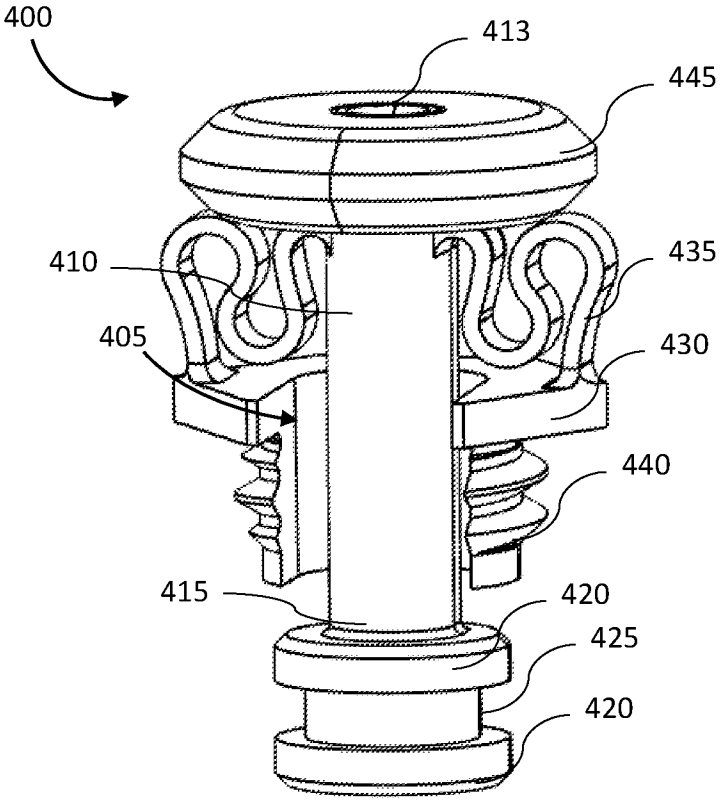
FIG. 22 is a perspective view of an injection molded combination check valve, orifice, spring, and plug for a humidifier system, according to an exemplary embodiment.

FIG. 22 shows a perspective view of the flow control component 400. The flow control component includes a piston 405, which has an upper portion 410 and a lower portion 415, where an orifice 413 is disposed within the upper portion 410 and is fluidly coupled to a fluid pathway extending through the length of the piston 405. The lower portion 415 includes one or more first flanges 420, which extend outward from the piston 405. As shown in FIG. 22, the lower portion 415 may include two first flanges 420, which form a groove 425 therebetween, where the groove 425 may accommodate one or more seals (e.g., o-rings, membranes, diaphragms, etc. therein).

As shown, the lower portion 415 may also include a second flange 430, which is disposed within a top region of the lower portion 415 adjacent the upper portion 410. The flange 430 may extend outwardly from the piston 405 and may partially or entirely surround the piston 405. The flange 430 may be coupled to or adjacently formed with a threaded collar 440, which is positioned below the flange 430. The flange 430 and the threaded collar 440 may together form an outlet plug (i.e., equivalent to the cap 393) to facilitate transfer of loads within the humidifying system (e.g., within the valve interface assembly 340). As shown, the upper portion 410 of the piston 405 is structured to receive a seal or sealing cap 445 (e.g., drain valve seal, gasket, o-ring flange, etc.), which may form a seal (i.e., in a manner equivalent to the flange or sealing cap 369) between the flow control component 400 and a surface of an adjacent scale control tray (e.g., scale control tray 323). Finally, as shown, the flow control component 400 includes a spring 435, which may be coupled to or integrally formed with the flange 430, where the spring 435 abuts the seal or sealing cap 445 to bias the seal or sealing cap 445 away from a sealing surface within the humidifying system. When the flow control component 400 is subject to water pressure, the piston 405 is displaced upward to form a seal with the sealing surface in the humidifying system. Such a configuration of the spring 435 may result in improved assembly convenience and potentially an improved (i.e., reduced) stress profile for the spring 435 as compared to an axial arrangement, such as with the spring 371. Furthermore, such a configuration of the spring 435 reduces a number of assembly steps of the flow control component 400 and, accordingly, reduces cost and/or complexity of the flow control component 400.

Figure 23:
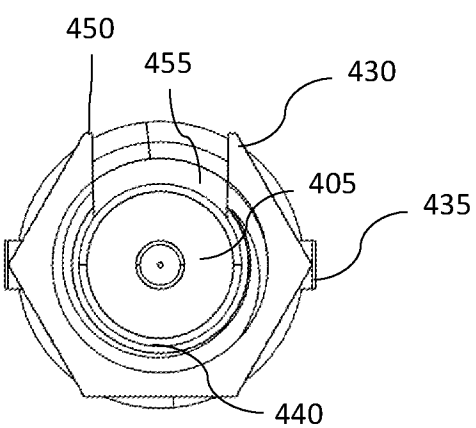
FIG. 23 is a top view of the combination check valve, orifice, spring, and plug of FIG. 22, according to an exemplary embodiment.

As shown in FIG. 23, the flange 430 may substantially surround the piston 405. In various embodiments, the flange 430 may have a geometric shape. For example, as shown in FIG. 23, an outer edge 450 of the flange 430 may have a substantially hexagonal shape. In other embodiments, the flange 430 may be rounded and extend equally in a radially direction about the circumference of the piston 405. In various embodiments, a radius or width of the flange 430 may be based on a width or diameter of a conduit within which the flow control component 400 may be disposed (e.g., a conduit similar or equivalent to the conduit 394). As shown, the flange 430 does not fully surround the piston 405 and instead may include a slot defined by an inner surface 455, where the inner surface 455 wraps around the piston 405. In various embodiments, the flange 430 may be structured to surround or not surround the piston 405 based on assembly requirements associated with the humidifying system (e.g., the system 300) and/or a width or diameter of a conduit within which the flow control component 400 is disposed (e.g., the conduit 394). Furthermore, as shown in FIG. 23, the spring 435 may be positioned on the flange 430 such that it extends outwardly from the piston 405 in a radial direction. As illustrated, the spring 435 may include two parts, where each part is formed on an opposing side of the piston 405. Together, the two parts of the spring 435 may be aligned such that the spring 435 extends between opposing edges of the flange 430, abutting the piston 405 at a midpoint.

Figure 24:
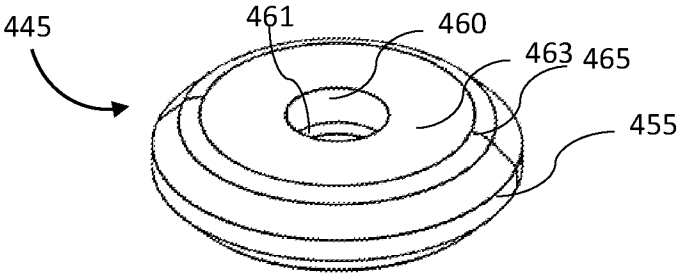
FIG. 24 is a perspective view of the plug of FIG. 22, according to an exemplary embodiment.

FIG. 24 illustrates the seal 445. As shown, the seal 445 may be frustoconical in shape. The seal 445 may be structured to have top portion 463 and a bottom portion 455, and a centrally disposed bore 460 extending in an axial direction through the seal 445. The bore 460 may be structured to receive the upper portion 410 of the piston 405. In various embodiments, the bore 460 may include one or more retention features 461 (e.g., a ridge, lip, protrusion, detent, groove, etc.) that may engage with a corresponding component disposed within the upper portion 410. The one or more retention features 461 may facilitate retention of the seal 445 on the upper portion 410 and prevent separation therebetween. As shown, the seal 445 may have a generally circular outer shape, where the top portion 463 has a smaller diameter than the bottom portion 455 such that an outermost surface 465 of the seal 445 slopes downward from the upper portion 463 toward the bottom portion 455. In various embodiments, the slope of the surface 465 may be based on a particular configuration or shape of one or more components within the humidifying system and/or a contour of an adjacent surface of a scale distribution tray (e.g., the tray 323). Accordingly, the seal 445 may have a shape that is complementary to one or more adjacent components within the humidifying system (e.g., system 300) to allow for a secure seal therebetween. In various embodiments, seal 445 may be formed from a rubber or rubber-like material, or from any other suitably flexible or elastic material (e.g., polymers) that may form a fluid seal between components in the humidifying system (e.g., system 300).

Figure 26:
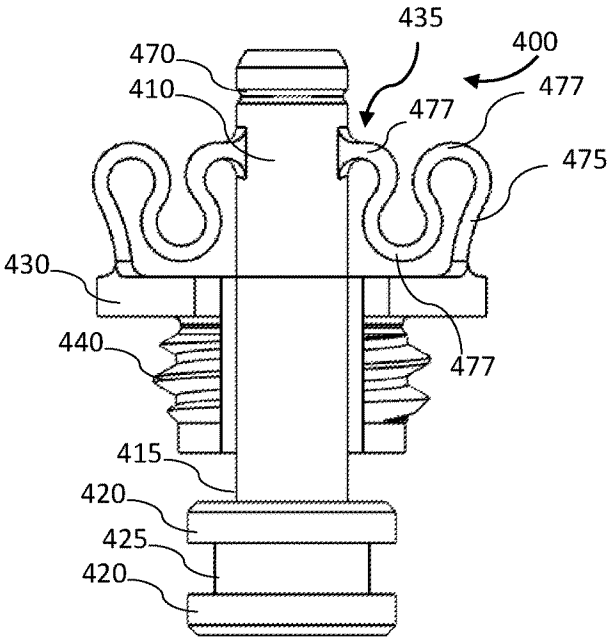
FIG. 26 is a side view of the combination check valve, orifice, and spring of FIG. 25, according to an exemplary embodiment.
Figure 25:
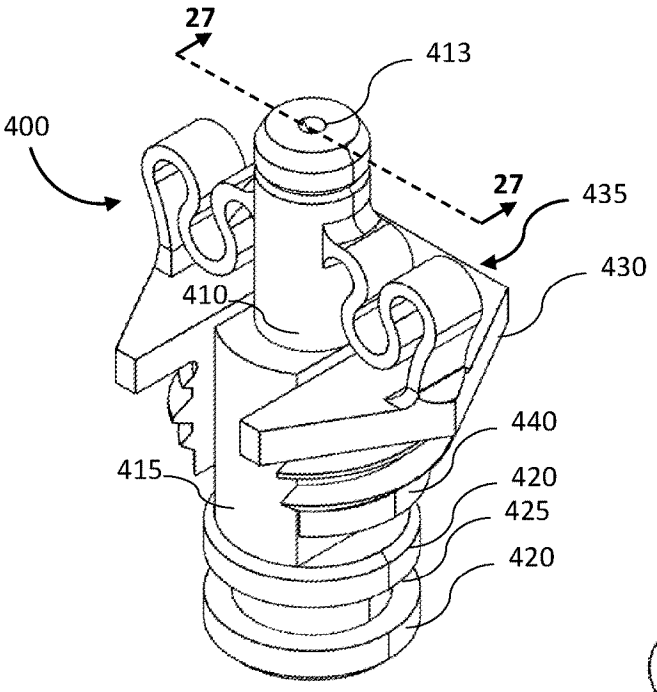
FIG. 25 is a perspective view of the combination check valve, orifice, and spring, according to an exemplary embodiment.

FIGS. 25 and 26 show the flow control component 400 with the seal 445 removed. As shown, the spring 435 may be coupled to or integrally formed with a side of the upper portion 410 of the piston 405 and an upper surface of the flange 430. As illustrated, the spring 435 may be structured as a ribbon 475, having a length that is substantially greater than a thickness thereof. Accordingly, as shown, the ribbon 475 may form a winding structure between the upper portion 410 and the flange 430 such that the ribbon 475 includes at least one bend 477 such that the highest point or lowest point corresponding to each bend 477 is substantially aligned in parallel with a longitudinal axis of the piston 405.

Figure 27:
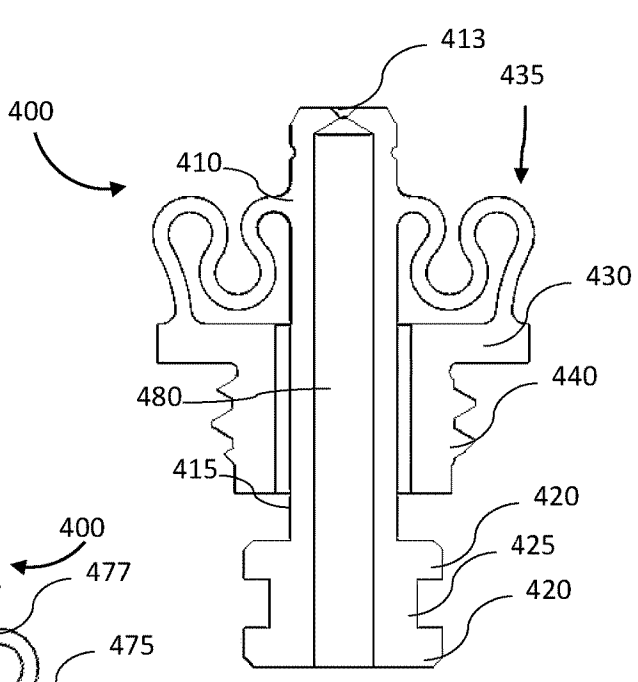
FIG. 27 is a cross-sectional view of the combination check valve, orifice, and spring of FIG. 25, taken along line 27-27 of FIG. 25, according to an exemplary embodiment.

Finally, as shown in FIG. 27, the orifice 413 may be fluidly coupled to a conduit 480, which extends longitudinally within the piston 405. During use, the flow control component 400 may be inserted into a conduit (e.g., conduit 394) within a humidifying system. The lower portion 415 of the piston 405 may extend into the conduit (e.g., conduit 394). Displacement may be limited and loads may be supported by a plug formed by the flange 430 and the collar 440, where the collar 440 may threadably engage with the conduit in which the flow control component 400 is inserted. Finally, the seal 445 may be coupled to the upper portion 410 of the piston 405 (e.g., via press fit, snap fit, friction fit, etc.) to form a seal between the flow control component 400 and an adjacent surface within the humidifying system (e.g., a surface of the scale control tray 323), where the spring 435 biases the seal 445 away from the adjacent surface. Accordingly, responsive to activation of a fluidly coupled solenoid valve (e.g., solenoid valve 350) and/or in response to a threshold fluid pressure, the flow control component 400 may selectively disengage the seal 445 from the adjacent surface to allow fluid flow through the conduit 480 and the orifice 413. In various embodiments, one or more portions of the fluid control component 400 may be formed by injection molding. In various embodiments, the structure of the fluid control component 400—which encompasses a check valve, orifice, spring, and plug in an a unitary, integrally formed part—may result in both simplification of design and reduction of failure points as compared to an analogous system having multiple, separately coupled parts.

Figure 29:
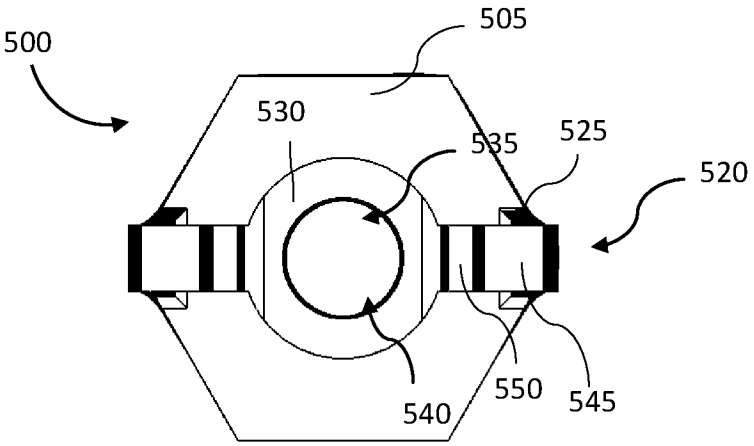
FIG. 29 is a top view of the flow control component of FIG. 28, according to an exemplary embodiment.
Figure 30:
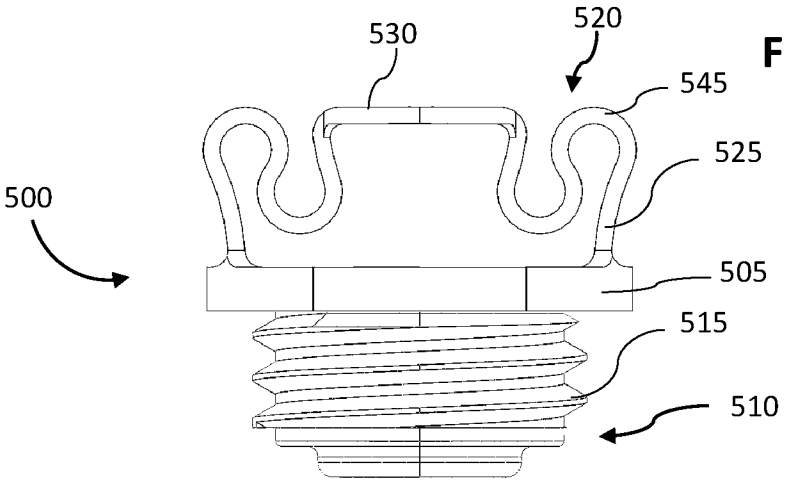
FIG. 30 is a side view of the flow control component of FIG. 28, according to an exemplary embodiment.
Figure 28:
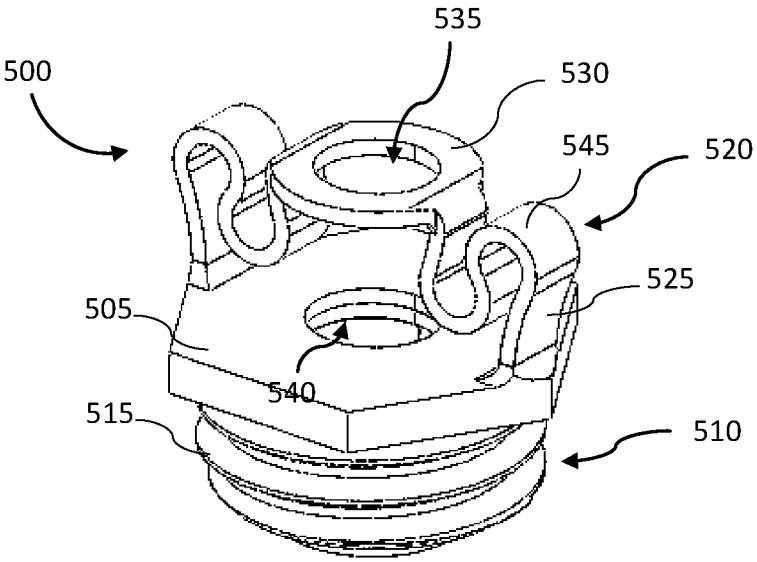
FIG. 28 is a perspective view of a flow control component, according to an exemplary embodiment.

In some embodiments, a flow control component may be configured to include a spring and a plug, where the spring and plug are integrally formed and are disposed separate from a piston and/or diaphragm. FIGS. 28-30 illustrate a flow control component 500. The flow control component 500 may be structured to fit within the humidifying system 300 (or additionally or alternatively within the humidifying systems 10 or 200) to replace the spring 371 and check valve 367 (or respective components within the humidifying systems 10 or 200). As indicated above, the flow control component 500 may be configured to interface with (e.g., engage, couple to, displace relative to, etc.) a piston and/or diaphragm to facilitate flow control within a humidifying system (e.g., humidifying systems 300, 10, and/or 200).

FIG. 28 shows a perspective view of the flow control component 500. The flow control component includes flange 505 and a body 510 (e.g., collar), which is integrally formed with and extends away from the flange 505 in an axially downward direction. As shown, the body 510 may have a generally cylindrical shape and may include a plurality of threads 515 disposed about an exterior portion of the body 510 to facilitate coupling the flow control component 500 within the humidifying system 300 (or the humidifying systems 10 and/or 200). In various embodiments, the flange 505 may have a geometric shape. For example, as shown in FIG. 28, the flange 505 may have a substantially hexagonal shape. In other embodiments, the flange 505 may be rounded and extend equally in a radially direction. In various embodiments, a radius or width of the flange 505 may be based on a width or diameter of a conduit within which the flow control component 500 may be disposed (e.g., a conduit similar or equivalent to the conduit 394).

The flow control component 500 also includes a spring member 520, which may be positioned on the flange 505 such that extends across a width of the flange 505. As illustrated, the spring 520 may include two elastic members 525, where each elastic member 525 is formed on an opposing side of a piston mount 530. As shown, the piston mount 530 includes a central aperture 535, which may be axially aligned with a central aperture or bore 540 of the body 510, where each of the apertures 535 and 540 are structured to receive a piston (e.g., similar or equivalent to the piston 368). Each of the elastic members 525 may be structured like a ribbon, having a length that is substantially greater than a thickness thereof. Accordingly, as shown, each of the elastic members 525 may form a winding structure between piston mount 530 and the flange 505 such that each elastic member 525 includes at least one bend 545 such that the highest point or lowest point corresponding to each bend 545 is substantially aligned in parallel with a longitudinal axis of the body 510.

During use, the flow control component 500 may be coupled within the humidifying system 300 (or systems 10 or 200) such that the body 510 is threadably engaged with one or more portions of the system 300. The flange 505 and the body 510 may together form an outlet plug (i.e., equivalent to the cap 393) to facilitate transfer of loads within the humidifying system 300 (e.g., within the valve interface assembly 340). Finally, as described above, the flow control component 500 includes the spring member 520, which may be coupled to or integrally formed with the flange 505, where the spring member 520 may be structured to act on the piston 368 to bias it away from a sealing surface within the humidifying system 300 (or systems 10 or 200). As indicated above, the flow control component may be configured to engage with or couple to a piston (e.g., similar or equivalent to the piston 368). Accordingly, when the flow control component 500 is subject to water pressure, the piston may be displaced upward to engage with a cap and/or seal (e.g., similar or equivalent to the seal/sealing cap 445) such that a fluid seal may be formed with a sealing surface in the humidifying system.

Figure 31:
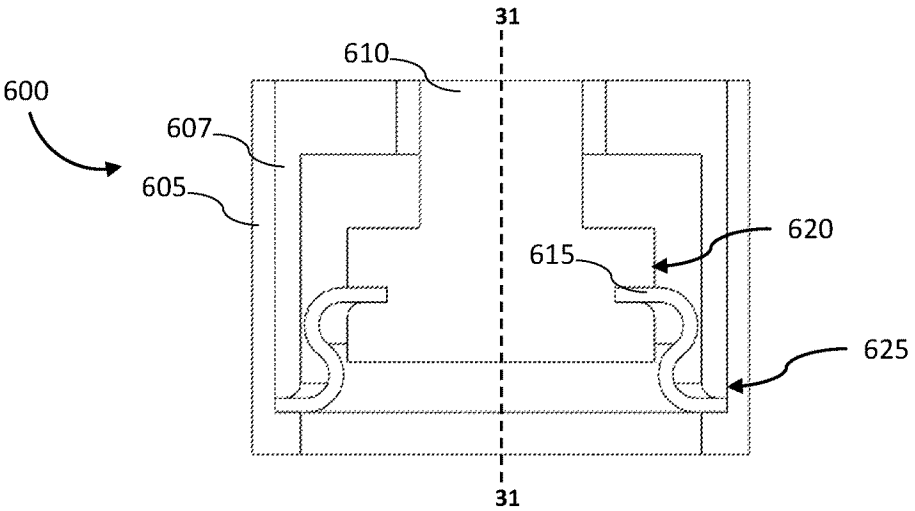
FIG. 31 is a side cross-sectional view of a flow control assembly, according to an exemplary embodiment.
Figure 32:
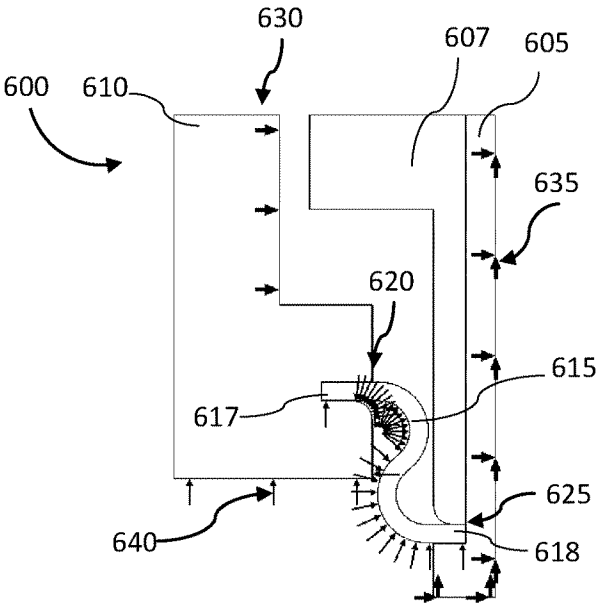
FIG. 32 is a side cross-sectional view of the flow control assembly of FIG. 31 illustrating a first configuration near a region disposed to the right of the line 31-31 of FIG. 31, according to an exemplary embodiment.
Figure 33:
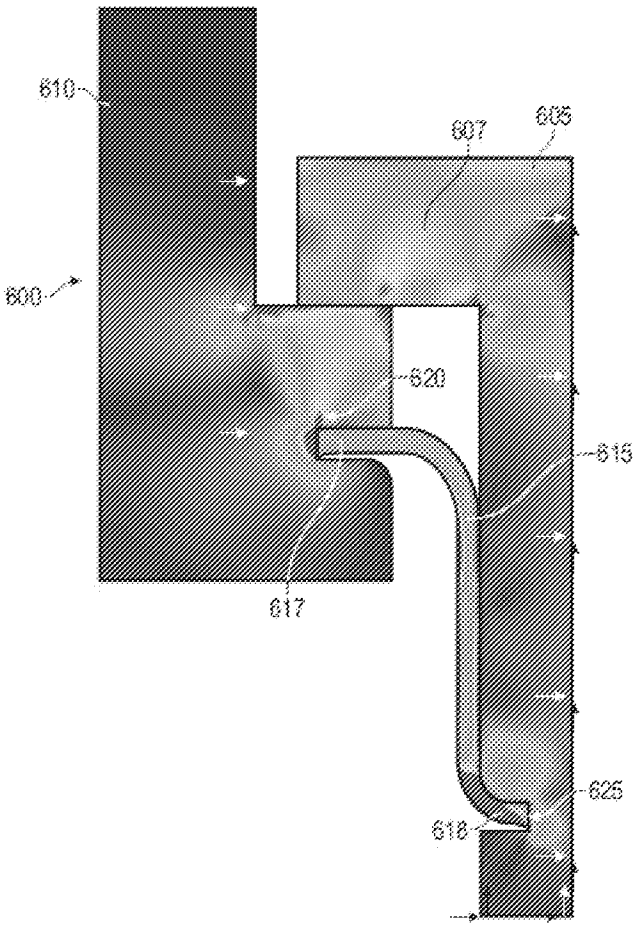
FIG. 33 is a side cross-sectional view of a stress distribution along the flow control assembly of FIG. 31 when the flow component is in a second configuration near a region disposed to the right of the line 31-31 of FIG. 31, according to an exemplary embodiment.

In some embodiments, an elastic member may be configured to engage with or couple to a piston (e.g., similar or equivalent to the piston 368) and a valve body to bias the piston away from a sealing surface in the humidifying system. FIGS. 31-33 show side views of a flow control assembly 600, which may be structured to facilitate control of water into an eductor (e.g., eductor 230 or 330) or into a drain outlet (e.g., drain outlet 260 or 360). As shown, the flow control assembly 600 includes a valve body 605 (e.g., similar or equivalent to the check valve 35, 267, or 367), which includes a valve plug 607. In some embodiments, the valve plug 607 is threaded. The flow control assembly 600 also includes a piston 610, which is configured to displace or articulate relative to the valve body 605 and the valve plug 607 such that the flow control component 600 may allow water flow (i.e., through the flow control assembly 600) when in a first configuration ("open configuration") and may prevent water flow when in a second configuration ("closed configuration"). When in the first configuration, the piston 610 is spaced from the valve plug 607, such as shown in FIGS. 31 and 32. When in the second configuration, the piston 610 abuts at least a portion of the valve plug 607, such as shown in FIG. 33.

The flow control assembly 600 also includes an elastic member 615 (e.g., membrane, spring, diaphragm, etc.), which is coupled to or engages with both the piston 610 and the valve body 605. As shown in FIG. 32, the elastic member 615 is structured such that a first end 617 is configured to engage with the piston 610 within a first region 620 and a second end 618 is configured to engage with the valve body 605 within a second region 625. In various embodiments, the first region 620 and/or the second region 625 may include one or more ridges, notches, grooves, or other features structured to facilitate retention of the elastic member 615. In other embodiments, the first and second ends 617, 618 are coupled to (e.g., bonded) to each of the first and second regions 620, 625, respectively. In various embodiments, the elastic member 615 may be a polymer, rubber, metal, or other material known in the art. In some embodiments, the elastic member 615 may be an ethylene propylene diene monomer (EPDM) rubber (e.g., EPDM 60A).

The elastic member 615 is configured to deform or stretch when the flow control assembly 600 is in the second configuration to prevent water from flowing out of the drain (i.e., as shown in FIG. 33) and return to an un-stretched state when the flow control assembly is in the first configuration (i.e., as shown in FIG. 32). Accordingly, during use, the elastic member 615 may be configured to bias the piston 610 away from the valve plug 607 such that the flow control assembly 600 is biased in the first configuration to allow water flow out of the scale control tray through the area previously blocked by the seal 369. In various embodiments, the elastic member 615 is configured to stretch or deform in response to an applied load 640 (e.g., from a water flow) of approximately 0.83 to 1.04 lbf. As depicted by the arrows 630 and 635 in FIG. 32, which represent reactive forces within the flow control assembly 600 in response to the applied load 640, the valve body 605, piston 610, and elastic member 615 are structured to resist out-of-plane motion and instead allow for axial motion of the piston 610 relative to the valve body 605. Furthermore, the axisymmetric structure of the flow control assembly 600, which includes the elastic member 615 coupled to each of the piston 610 and the valve body 605 about an entire circumference thereof (i.e., in the respective regions 620 and 625), may prevent tilting or other out-of-plane motion of the piston 610 relative to the valve body 605 during operation of the flow control assembly 600.

Notwithstanding the embodiments described above in FIGS. 1-33, various modifications and inclusions to those embodiments are contemplated and considered within the scope of the present disclosure.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A humidifying system comprising:

a water panel;

a distribution tray fluidly coupled to the water panel, the distribution tray configured to provide a flow of water to the water panel;

a scale control tray in fluid communication with the water panel, the scale control tray configured to receive wastewater from the water panel;

a valve assembly fluidly coupled to the scale control tray and a water supply to form an eductor, the valve assembly configured to control a flow of water through the eductor, and the eductor configured to supply a combination of water from the scale control tray and the water supply to the distribution tray; and a collection member disposed between the water supply and the scale control tray, the collection member configured to enclose at least a portion of the valve assembly.

2. The system of claim 1, wherein the scale control tray comprises:

a valve seat configured to mate with an orifice of the valve assembly; and an outer eductor wall having one or more openings therein to facilitate water flow from a basin of scale control tray to an interior volume of the eductor.

3. The system of claim 1, wherein the valve assembly comprises a first inlet and a second inlet, the second inlet in fluid communication with the scale control tray, wherein a flow of wastewater from the scale control tray through the second inlet is controlled by a first valve within the valve assembly and a flow of freshwater from the water supply through the first inlet is controlled by a second valve, wherein the first valve is a check valve and the second valve is a solenoid valve, and wherein a configuration of the first valve is based on an operational state of the second valve.

4. The system of claim 3, wherein the first valve is a piston type check valve.

5. The system of claim 4, wherein the valve assembly comprises a spring disposed between the first valve and the eductor, the spring configured to bias the first valve in an open configuration.

6. The system of claim 5, wherein the operational state of the second valve comprises an on state and an off state that control function of the eductor, wherein when the second valve is in the off state, the first valve is in the open configuration, and wherein when the second valve is in the on state, the first valve is in a closed configuration.

7. The system of claim 6, wherein when the first valve is in the open configuration, a flow of wastewater from the scale control tray passes through a gap between a sealing flange of an orifice to a drain outlet.

8. The system of claim 1, further comprising an overflow feature fluidly coupled to a valve to enable selective drainage of wastewater from the scale control tray.

9. The system of claim 3, wherein the collection member is disposed between the first inlet and the scale control tray.

10. The system of claim 1, wherein at least one of the eductor or the valve assembly is integrally formed with the scale control tray.

11. The system of claim 10, further comprising a frame, wherein the water panel is pivotably coupled to the frame and further coupled to the valve assembly through an opening in the frame.

12. The system of claim 1, wherein the valve assembly is removably coupled to the scale control tray.

13. A humidifying system comprising:

a frame;

a water panel coupled to the frame;

an eductor in fluid communication with the water panel, the eductor configured to provide a flow of water to the water panel;

a scale control tray in fluid communication with the water panel, the scale control tray configured to receive wastewater from the water panel;

a valve assembly fluidly coupled to a water supply at a first inlet and fluidly coupled to the eductor via an outlet, the valve assembly configured to control a flow of water through the eductor; and a collection member disposed between the first inlet and the scale control tray, the collection member comprising a body configured to enclose at least a portion of the valve assembly;

wherein the valve assembly comprises a second inlet, the second inlet in fluid communication with the scale control tray, wherein a flow of wastewater from the scale control tray through the second inlet is controlled by a first valve within the valve assembly and a flow of freshwater from the water supply through the first inlet is controlled by a second valve; and wherein a configuration of the first valve is based on an operational state of the second valve.

14. The system of claim 13, wherein the valve assembly is removably coupled to the scale control tray.

15. The system of claim 14, further comprising a distribution tray fluidly coupled to the water panel, the distribution tray structured to facilitate a flow of water to the water panel.

16. The system of claim 15, wherein the frame comprises a first end and a second end, the eductor disposed at the first end, and wherein the valve assembly is couplable to the first end or the second end.

17. The system of claim 13, wherein the body has a shape that is complementary to a shape of the valve assembly.

18. The system of claim 17, wherein the first inlet is in fluid communication with the body.

19. The system of claim 18, wherein the collection member further comprises a drain cleaning tablet holder configured to hold a drain cleaning tablet in a position within a water flow from the body to a drain outlet of the collection member.

20. A humidifying system comprising:

a water panel;

a distribution tray fluidly coupled to the water panel, the distribution tray configured to provide a flow of water to the water panel;

a scale control tray in fluid communication with the water panel, the scale control tray configured to receive wastewater from the water panel;

a valve assembly fluidly coupled to the scale control tray and a water supply to form an eductor, the valve assembly configured to control a flow of water through the eductor, and the eductor configured to supply a combination of water from the scale control tray and the water supply to the distribution tray;

wherein the valve assembly comprises a first inlet and a second inlet, the second inlet in fluid communication with the scale control tray, wherein a flow of wastewater from the scale control tray through the second inlet is controlled by a first valve within the valve assembly and a flow of freshwater from the water supply through the first inlet is controlled by a second valve, wherein the first valve is a check valve and the second valve is a solenoid valve, and wherein a configuration of the first valve is based on an operational state of the second valve;

wherein the first valve is a check valve; and wherein the valve assembly comprises a spring disposed between the first valve and the eductor, the spring configured to bias the first valve in an open configuration.

21. The humidifying system of claim 20, wherein the first valve comprises a piston and a cap, the piston configured to be received within a bore of the cap.

* * * * *